US010085910B2

(12) United States Patent
Fulkerson

(10) Patent No.: US 10,085,910 B2
(45) Date of Patent: Oct. 2, 2018

(54) SAFETY WALKER

(71) Applicant: Michel Fulkerson, Scottsdale, AZ (US)

(72) Inventor: Michel Fulkerson, Scottsdale, AZ (US)

(73) Assignee: Safety Walker LLC, Scottsdale, AZ (US)

( * ) Notice: Subject to any disclaimer, the term of this patent is extended or adjusted under 35 U.S.C. 154(b) by 0 days.

(21) Appl. No.: 15/651,014

(22) Filed: Jul. 17, 2017

(65) Prior Publication Data

US 2017/0319425 A1 Nov. 9, 2017

Related U.S. Application Data

(63) Continuation of application No. 15/492,847, filed on Apr. 20, 2017, now Pat. No. 9,757,304, which is a continuation-in-part of application No. 15/442,703, filed on Feb. 26, 2017, now Pat. No. 9,770,381, which is a continuation-in-part of application No. 15/236,744, filed on Aug. 15, 2016, now Pat. No. 9,579,249, which is a continuation-in-part of application No. 15/150,297, filed on May 9, 2016, now Pat. No. 9,468,579.

(60) Provisional application No. 62/173,009, filed on Jun. 9, 2015, provisional application No. 62/479,559, filed on Mar. 31, 2017.

(51) Int. Cl.
*A61H 3/04* (2006.01)

(52) U.S. Cl.
CPC ..... *A61H 3/04* (2013.01); *A61H 2003/046* (2013.01); *A61H 2201/0173* (2013.01); *A61H 2201/1215* (2013.01); *A61H 2201/1633* (2013.01); *A61H 2201/1638* (2013.01)

(58) Field of Classification Search
CPC . A61H 3/04; A61G 5/14; A61G 5/027; A61G 5/028
USPC ..... 280/87.021; 482/69
See application file for complete search history.

(56) References Cited

U.S. PATENT DOCUMENTS 2,459,066 A * 1/1949 Duke ..... A61H 3/04 297/215.13
3,488,088 A * 1/1970 Goldberg ..... A61H 3/04 297/5
3,778,052 A * 12/1973 Andow ..... A61H 3/008 135/67
4,068,857 A * 1/1978 Karlsson ..... A61G 5/02 280/259

(Continued)

*Primary Examiner* — Jeffrey J Restifo
(74) *Attorney, Agent, or Firm* — Invention to Patent Services; Alex Hobson

(57) ABSTRACT

A safety walker has a support extension that extends from the front of the moveable support frame toward the back end opening and is centrally located. A user may enter the safety walker and straddle the support extension and the actuate the support extension up to a secure position, whereby in the event of a fall the support extension will support the user. The support extension may be coupled with an actuator system having a motor to raise or pivot the support extension. A safety strap may be attached to the extended end of the support extension and extend above the support extension towards the front of the movable support frame. The safety strap may provide a flexible support that is more comfortable for support in the event of a fail. A gate may be coupled with an actuator system and automatically close as the support extension is lifted.

19 Claims, 36 Drawing Sheets

(56) References Cited

U.S. PATENT DOCUMENTS 4,188,966 A * 2/1980 Palmer ..... A61H 3/04 135/67
4,239,248 A * 12/1980 Ewers ..... A61G 5/02 280/270
4,342,465 A * 8/1982 Stillings ..... A61H 3/04 135/67
5,040,556 A 8/1991 Raines
5,058,912 A * 10/1991 Harroun ..... A61H 3/04 135/67
5,083,806 A * 1/1992 Brown ..... A47D 13/043 248/188.5
5,255,697 A * 10/1993 Grauer ..... A61H 3/04 135/67
5,476,432 A * 12/1995 Dickens ..... A61H 3/04 135/67
5,520,402 A * 5/1996 Nestor ..... A61G 5/00 280/250
D400,829 S * 11/1998 Tomlinson ..... D12/128
6,220,620 B1 * 4/2001 Harroun ..... A61G 5/1059 280/650
6,425,634 B1 * 7/2002 Romero ..... A61G 5/14 297/316
7,568,712 B2 * 8/2009 Kovachi ..... A61H 3/008 280/23.1
8,720,914 B1 * 5/2014 Heath ..... A61H 3/04 135/67
8,968,163 B1 * 3/2015 Vidmar ..... A61H 3/008 482/43
9,180,064 B2 11/2015 Prather
9,278,042 B2 * 3/2016 Osterhaus ..... A61H 3/04
9,468,579 B1 * 10/2016 Fulkerson ..... A61H 3/04
9,579,249 B2 * 2/2017 Fulkerson ..... A61H 3/008
9,757,304 B2 * 9/2017 Fulkerson ..... A61H 3/04
9,770,381 B1 * 9/2017 Fulkerson ..... A61H 3/04
2003/0137119 A1 * 7/2003 Razon ..... A61H 3/008 280/87.021
2004/0002407 A1 * 1/2004 Hawkes ..... A61H 3/008 482/69
2005/0268397 A1 * 12/2005 Nativ ..... A61G 7/1015 5/86.1
2006/0254631 A1 11/2006 Mulholland
2006/0261569 A1 * 11/2006 Delhotal ..... A61G 5/00 280/87.021
2007/0173380 A1 * 7/2007 Gabel ..... A61G 5/14 482/52
2007/0194547 A1 * 8/2007 Steiner ..... A61G 5/14 280/87.021
2009/0242006 A1 10/2009 Warren
2013/0113178 A1 * 5/2013 Goldish ..... A61G 5/14 280/250
2014/0296039 A1 * 10/2014 Shaw ..... A61H 3/04 482/68
2015/0238381 A1 * 8/2015 Swiniarski ..... A61H 3/00 297/5
2015/0272798 A1 * 10/2015 Hsieh ..... A61G 5/14 297/313
2015/0342822 A1 * 12/2015 Osterhaus ..... A61H 3/04 280/657
2016/0051427 A1 * 2/2016 Purwar ..... A61G 7/1046 482/5
2016/0374889 A1 * 12/2016 Fulkerson ..... A61H 3/008 280/47.34

* cited by examiner

SAFETY WALKER

CROSS REFERENCE TO RELATED APPLICATIONS

This application is a continuation of U.S. patent application Ser. No. 15/492,847, filed on Apr. 20, 2017, entitled Safety Walker and currently pending, which is a continuation in part of U.S. patent application Ser. No. 15/442,703 filed on Feb. 26, 20217, entitled Safety Walker and currently pending, which is a continuation in part of U.S. patent application Ser. No. 15/236,744, filed on Aug. 15, 2016, entitled Safety Walker and issued as U.S. Pat. No. 9,579,249 on Feb. 28, 2017, which is a continuation in part of U.S. patent application Ser. No. 15/150,297, filed on May 9, 2016, entitled Safety Walker and issued as U.S. Pat. No. 9,468,579 on Oct. 18, 2016, which claims the benefit of priority to U.S. provisional patent application No. 62/173,009 filed on Jun. 9, 2015 and entitled Rehabilitation Safety Walker; and this application claims the benefit of priority to U.S. provisional patent application No. 62/479,559, filed on Mar. 31, 2017 and entitled Safety Walker; the entirety of all applications listed above are incorporated by reference herein.

BACKGROUND OF THE INVENTION

Field of the Invention

The invention relates to safety walkers and particularly those with a fail restraint.

Background

The elderly and those recuperating from an injury or surgery often require assistance to walk. Some assisted walking devices require complex harness arrangements to prevent ground level falls. Many of these harness and restraint systems require more than one person and thereby limit a person's ability to move about unassisted. Other devices require twisting and/or bending to secure a restraint which is difficult or not possible for many users. Still other assisted walking devices utilize a complete enclosure having a door or gate portion that must be opened for entry, and subsequently shut and secured to ensure the safety of the user. These closures can also be difficult to secure and operate and again may limit a person's unassisted mobility.

There exists a need for a safety walker that is easy to enter, requires no assistance to operate, requires no buckling of harnesses and effectively prevents ground level falls.

SUMMARY OF THE INVENTION

The invention is directed to a safety walker having a safety strap that is easily configured between the user's legs to prevent falling. The safety walker of the present invention incorporates a strap that is coupled to a strap actuator that pivots to lower and raise an actuating end of a safety strap. A user simply has to step into the safety walker, wherein they step over the safety strap as they enter through the back opening, and then actuate the pivoting strap mechanism to raise the back end of the safety strap up into a locked and secure position. The safety strap extends through the user's legs and thereby prevents them from falling while being non-obtrusive as they maneuver the safety walker.

An exemplary safety walker comprises a movable support frame having an opening for easy entry. An exemplary support frame has a base with a plurality of wheels to allow movement of the safety walker in any suitable direction, including forwards, backward, left, right, and rotational movement. An exemplary support frame has a front end, a left side and a right side incorporating support members that are coupled together. An exemplary support frame may have a rounded shape or may be square or rectangular in shape. An exemplary safety walker may be horseshoe shaped having a rounded front with two extensions that extend toward the back of the support frame, to a back end opening for example. The left and right sides extend back from the front end to an extended end. The space between the left and right side extended ends creates a back end opening for a user to enter the safety walker. The top support members may act as hand rails for a user to hold onto as they guide the safety walker. The top support members may be at a height suitable for a person, such as an adult person to hold onto while walking. For example, the height of the top support members may be at least about 40 cm, or at least about 50 cm, at least about 70 cm, at least about 90 cm and any range between and including the heights provided. The left and right sides and/or the left and right top support members may be parallel with each other and spaced apart to provide room for a user to enter and maneuver the safety walker. The width between the top left and right support members may be, for example, at least about 40 cm, at least about 50 cm, at least about 60 cm and any range between and including the widths provided. In an exemplary embodiment, the outer width of the safety walker is no more than about 50 cm or no more than about 60 cm to allow the safety walker to fit through doorway openings. The movable support frame may be made out of metal, plastic, composites or any other material that provides enough structural stability to support a user, such as an adult that may weigh about 150 lbs or more, about 200 lbs or more, about 250 lbs or more and even 300 lbs or more.

An exemplary safety walker comprises a pivoting strap mechanism that pivots the back actuating end of the strap up after a user has entered into the safety walker. In an exemplary embodiment, the safety strap is attached to the front end of the moveable support frame and extends back where it is attached to a strap actuator. The entry end of the strap actuator moves up and down to raise and lower the actuating end of the strap. In an entry position, the strap is proximal to the floor, and in a secure position, the strap is raised from the floor and will support a person from falling. The entry end of the strap actuator may be moved by pivoting about a pivot attached to the moveable support frame or by a linkage coupled with a handle actuator. In an exemplary embodiment, a handle actuator and strap actuator are a one-piece rigid member that pivots about a single pivot point. In another exemplary embodiment, the handle actuator is coupled to the strap actuator by a linkage, such as a flexible or rigid linkage. In this embodiment, the handle actuator may rotate about a handle actuator pivot attached to the moveable support frame and a linkage may extend from the handle actuator to the strap actuator, whereby rotation of the handle actuator moves the strap actuator. In a preferred embodiment, the pivoting strap mechanism comprises a strap actuator on opposing sides of the safety walker, a left and a right strap actuator, as described herein. This configuration may provide more rigidity and enable higher loads to be carried by the strap. A back end coupler may extend from a left and right strap actuator at the entry end, or back-end, of the strap actuators. The actuating end of the safety strap may be attached to the back end coupler. Likewise, a left and right strap actuator may comprise a front end coupler that extends between the two strap actuators proximal to the pivot end or handle end. In the entry position, the back end coupler and strap are either touching the floor or are very close to the floor to enable a person to enter and step over them with ease. In the secure position, the entry end of the strap actuator is elevated to where it is locked into the secure position by an actuator lock mechanism, such as a latch. The actuating end of the strap is now elevated off of the floor and will restrain a user in the event of a fall.

As described, in an entry position, the strap and back end coupler of the strap actuator are proximal to the floor to allow easy entry into the safety walker. For example, the safety strap and back end coupler may be no more than 7 cm off the floor, no more than about 5 cm off the floor, no more than about 3 cm of the floor and any range between and including the height off the floor provided in an exemplary embodiment, the back end coupler is a flat support member that provides enough structural support but is low profile for ease of entry into the safety walker. Likewise, the safety strap may have a thickness that is sufficiently low profile. The safety strap may be a fabric that is woven and may have a width that is sufficient to secure a person during a fall. The width of the strap may be, for example, at least about 4 cm, at least about 5 cm, at least about 7 cm, at least about 10 cm, at least about 15 cm and any range between and including the safety strap widths provided. It is important that the safety strap not be too wide as it may become too obtrusive for a person to walk. The thickness of the safety strap may be less than about 2 cm, less than about 1 cm, less than about 0.5 cm, less than about 0.25 cm and any range between and including the thickness values provided.

As described, in a secure position, the strap actuator is locked into a forward rotation position by an actuator lock mechanism. In an exemplary embodiment, the actuator lock mechanism automatically locks the strap actuator into position. For example, a latch may be deflected by a portion of the strap actuator as it is rotated forward and then secure the strap actuator in position. A latch may secure the strap actuator by gravity or there may be a spring strap actuator mechanism that ensures a firm retention of the strap actuator in a secure position. In an exemplary embodiment, an actuator lock mechanism secures a front end coupler of the strap actuator in position. An exemplary actuator lock mechanism may have a simple actuator release mechanism, such as a lever or bar or handle that is actuated to release the strap actuator from the lock, or latch. In an exemplary embodiment, a actuator release is a handle that is coupled with the actuator lock mechanism and actuating the release enables the strap actuator to rotate back to allow the user to exit from the safety walker. The back end of the strap actuator will drop freely to the floor and the person may simply back out of the safety walker.

An exemplary pivoting strap mechanism may comprise one or more dampers to ensure the back end of the strap actuators, or the back end coupler, does not fall too rapidly to the floor, thereby damaging the floor and/or the safety walker. A damper, comprising a cylinder and piston, for example, may be coupled between the strap actuator and the movable support frame.

In an exemplary embodiment, a safety walker comprises a left and a right strap actuator that are coupled together proximal the front or near the handles by a front end coupler and are coupled together proximal the back end, by a back end coupler. A connected support structure greatly increases the rigidity and load bearing capability of the pivoting strap mechanism. When a left and right strap actuator are incorporated, the back end coupler may be a thinner material to facilitate ease of entry into the safety walker.

In an exemplary embodiment, the safety strap is attached to a support member of the front end of the movable support frame and is attached to the back end coupler. The strap may be attached to these support members by being looped around them, tied to them or otherwise secured. The length of the strap is fixed and extends between the front end support member and the back end coupler. The strap may be loose and droop between these two support members but the length of the strap does not require adjustment, such as tightening or shortening, to provide effective support when a person falls. In an exemplary embodiment, the back end of the safety strap, the actuating end, is simply raised up by rotation of the strap actuator upon entry.

An exemplary safety walker may comprise a wheel lock mechanism to allow a user to lock the wheel whenever desired, or particularly upon entry and/or exit. A wheel lock actuator may be positioned in an ergonomic location to allow easy engagement and disengagement of the wheel lock. A lever may be positioned along one of the sides of the moveable support structure, such as up along a top support member. A user may simply rotate the wheel lock actuator to engage the wheel lock. A cable or other linking mechanism may couple the wheel lock actuator with the wheel lock.

In an exemplary embodiment, a strap actuator system comprises a motor that lifts the actuating end of the strap up through a connection with a strap actuator or pivoting strap mechanism, or through connection of cables, belts, chains and/or wires with a strap-bar. A tether, as used herein, refers to a flexible connection with a motor to actuate a strap bar and includes, but is not limited to, cables, belts, chains, and wires. A strap-bar is a bar that extends across the back end of the movable support frame and has the actuating end of the strap connected thereto. An exemplary motorized strap actuator system may comprise an electric motor that winds up cables that extend from the strap-bar or strap bar assembly to the motor, or portion of a take-up system coupled with the motor. A user interface may be used to initiate the lifting of the strap-bar after entering into the movable support frame. The strap-bar may be guided up along rails, wherein the strap-bar of a portion of the strap-bar assembly engages with the rail to guide the strap-bar up and down. A rail may comprise a protrusion and the strap-bar assembly may extend around a portion of the protrusion, or vice versa. For example, a rail may have a dove-tail protrusion and the strap-bar assembly, or rail coupling may have a dove-tail shaped recess for coupling around the dove-tail shaped protrusion. The strap-bar may have a gear that engages with teeth or a linear gear that extends along the rail to cause the strap-bar to rotate and wind up slack in the strap. The strap may be wound around the strap-bar as it approaches the top of the rail, for example. This enables the movable support frame to have a shorter length and, whereby the strap can be long enough to rest on the floor for entry and then be wound up around the strap-bar to provide adequate fall support, wherein the strap is taught enough between the user's legs. A latch or other suitable type of catch may be configured proximal to the top of the rails to lock the strap-bar in an up or secure position. A strap-bar release lever may be provided to release the latch and allow the strap-bar to lower back down to an entry position, with the strap-bar proximal the floor. The strap-bar release lever may be configured near the front of along the support frame and may be coupled to the latch by a coupling element, such as a wire or cable. In an alternative embodiment, a crank may be provided in place of or in combination with the motor to allow a user to lift the strap-bar by turning the crank, or a user may further tighten the strap by rotating the crank.

In another exemplary embodiment, a motor is configured to pivot or rotate a strap actuator, as described herein. Instead of handles to pivot the strap actuator and raise the back-end coupler and the strap coupled thereto, a motor may be coupled to the strap actuator, directly or through gears, to rotate the strap actuator. In an exemplary embodiment, an electric motor drives a worm gear that couples with a drive gear that is in plane with the strap actuator. In this embodiment, the worm gear rotates orthogonally to the drive gear, thereby making the drive system more compact. Again, a user interface may be provided to initiate the motor and raise the actuating end of the strap. The user interface may have a lever for raising and lowering the strap whereby a user can stop the raising of the strap to a comfortable position for their height. A latch may be configured to lock the strap actuator or the back-end coupler at an elevated and secure position and again a release may be configured to allow a user to release the latch and allow the actuating end of the strap to be lowered back down. A latch and release may ensure that the strap remains in a secure and locked position until the user is ready to exit the safety walker.

An exemplary motor may be a screw motor, or linear screw actuator, that spins a threaded shaft and wherein a threaded coupler moves up and down along the rotating threaded shaft. A threaded coupler may be coupled with the strap bar to raise the strap bar up and lower the strap bar down. A screw motor may be configured on either side of the support frame or on only one side of the support frame. In an exemplary embodiment, a screw motor, or any of the other actuator systems and motors may be configured to more a strap assembly up and down. A strap assembly comprises a safety strap attached to, and extending from, a back end coupler to a front end coupler, and an assembly extension that couples the back end coupler to the front end coupler. The assembly extension may have a threaded coupler that interfaces with a threaded shaft of a screw motor to raise and lower the assembly extension and thereby raise and lower the back end coupler as well as the front end coupler, and the safety strap. The threaded shaft of the screw motor may be coupled with any portion of the strap assembly, including the assembly extension that extends from the back end coupler to the front end coupler, the back end coupler, or the front end coupler, for example. A threaded coupler may be attached to or be an insert into any of these components of the strap assembly. With this system, the strap may be maintained in a relatively taught configuration between the front and back couplers and the strap may be raised up in this taught configuration, eliminating the need for tightening of the safety strap after raising it up with the back coupler. In an exemplary embodiment, the safety strap extends from the front end coupler to the back end coupler, or strap bar, and is taught requiring no tightening of the safety strap when it is moved up to a secure position. In addition, the front end coupler and the back end coupler, or strap bar may be substantially parallel with each other and thereby move safety strap up in a substantially horizontal orientation, such as within about 20 degrees offset from the front to the back, or more preferably within about 15 degrees offset from the front end coupler to the back end coupler.

An exemplary safety walker comprises a support extension that extends along the length of the safety walker from the front toward the back or back-end opening. A support extension may provide support to prevent a person from falling when located within the safety walker with their legs straddling the support extension. An exemplary support extension is rigid and free-standing, wherein it will maintain a shape under a load, such as a metal rod or beam. An exemplary support extension is a rod or rigid elongated member that may have a rounded top surface to provide a comfortable support and reduce injury in the event of a fall. A support extension may be padded for comfort along the top of the support extension. An exemplary support extension extends from a position proximal to the front of the moveable support frame toward the back and is substantially centered between the left and right sides of the moveable support frame. An exemplary support extension extends back toward the backend opening of the moveable support frame from forward position. An exemplary support extension has a horizontal portion or a portion that extends substantially horizontal when in an up and secure position and may comprises a vertical support portion that extends up proximal the extended end, or back end of the support extension. A support extension may be coupled with an actuator system that moves the support extension up and down. The front end of the support extension may be coupled with the actuator system and it may move the front end of the support extension and thereby the rest of the rigid support extension up. The actuator system may comprise a motor and a user may utilize a user interface to drive the support extension up and down. The support extension may pivot about a support extension pivot and the rotation of the support extension about the support extension pivot may be manually, such as by a lever attached to the support extension, or by an actuator system comprising a motor to pivot the support extension. The extended end of the support extension may rotate up about the support extension pivot to raise the support extension to a secure orientation or position.

A safety strap may be attached to the support extension and extend above the support extension to catch a person from falling. The actuating end of the safety strap may be couple with the extended end or proximal to the extended end of the support extension.

An exemplary safety walker may comprise a gate that extends across a portion of the opening of the safety walker between the left and right sides of the moveable support frame. A gate may extend across the back-end opening or be configured more proximal to the front of the safety walker from the back-end opening. A gate may be coupled with a manual or motorized actuator and may move from an entry orientation, wherein it does not impede entry into the safety walker, to a secure orientation, wherein it extends a portion of the distance between the left and right sides. An exemplary gate may be coupled with a support extension, such as at or near the extended end of the support extension and may comprises one or two portions that actuate from the entry orientation to the secure orientation. Again, an actuator system may be coupled to the gate, such as by a cable to actuate the gate from entry to secure orientations. In an exemplary embodiment, a gate comprises two portions attached to the extended end of a support extension and a cable extending from a motorized actuator system pivots the gates out to extend horizontally as the support extension is raised up to a secure orientation. In another embodiment, a gate is attached to the moveable support frame and may extend vertically in an entry orientation and horizontally in a secure orientation. Again, a manual actuator or motorized actuator system may be linked with the gate to move it. In another exemplary embodiment, a left and right gate are attached to the moveable support frame on the left and right sides respectively. The left portion rotates out from the left side and the right portion rotates out from the right side of the support frame. Both the left and right gates may be configured between the back end and the front end of frame and may comprise pads to allow a person to sit on the gates, wherein the pair of gates act as a seat in a secure orientation.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of his specification, illustrate embodiments of the invention, and together with the description serve to explain the principles of the invention.

DETAILED DESCRIPTION OF THE ILLUSTRATED EMBODIMENTS

Figure 1:
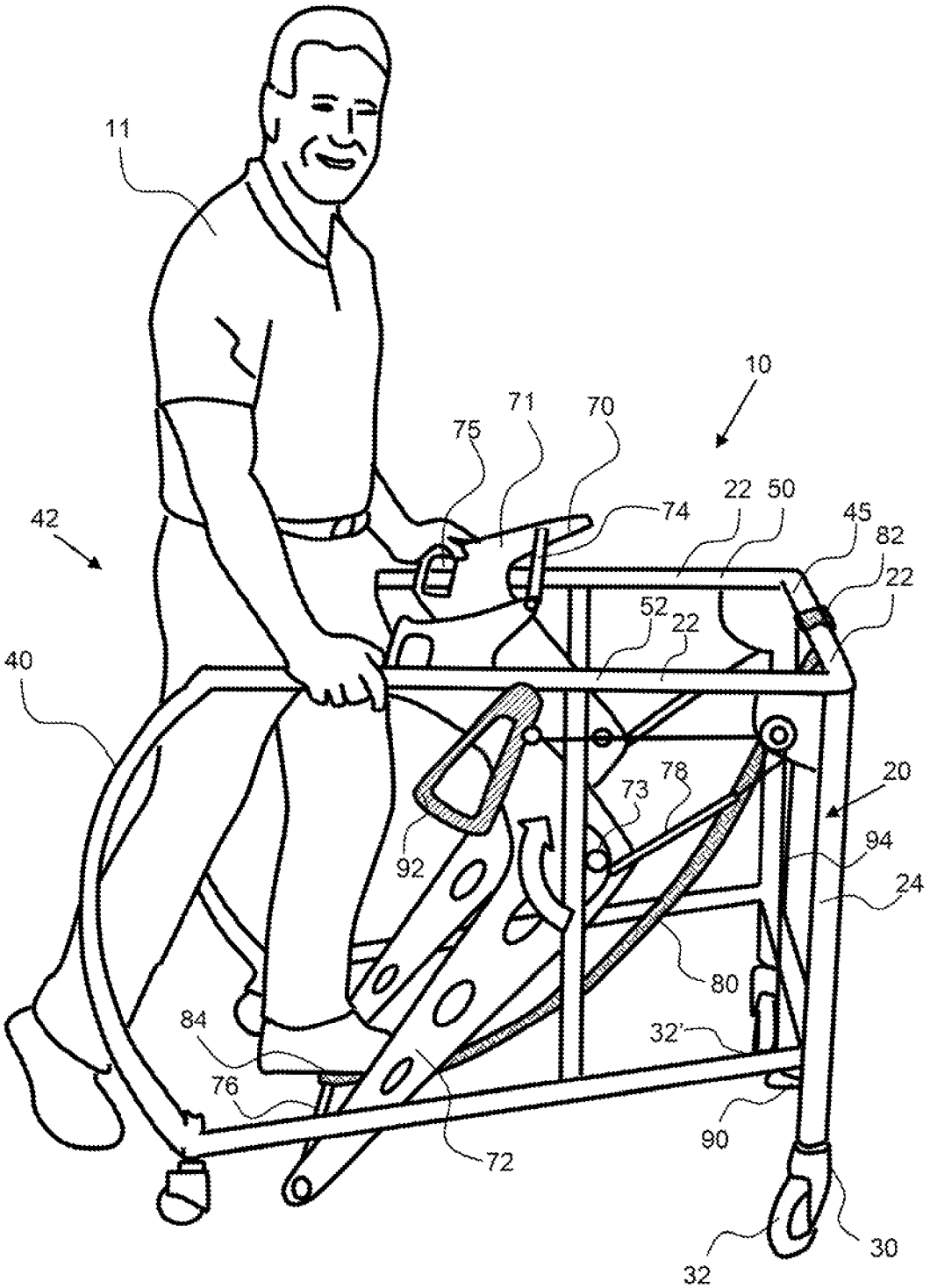
FIG. 1 shows a side view of an exemplary safety walker with a person entering the back end opening and stepping over the back end coupler of the pivoting safety strap mechanism.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale; some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes." "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

Definitions:

A support extension that is substantially centered between the left and right sides of the moveable support frame extends from a front attached end towards the back of the moveable support frame, along a length direction of the moveable support frame and allows a person to enter the safety walker and straddle the support extension. Substantially centered or centrally located, as used herein to describe the position of the support extension of safety strap with respect to the width of the moveable frame or movable frame opening, the gap between the left and right sides, is within about 25% of a center of said gap and preferably within about 15% of center of said gap.

As shown in FIG. 1, a person 11 is entering an exemplary safety walker 10 through the back end opening 42 and stepping over the back end coupler 76 of the pivoting safety strap mechanism 70. The person 11 enters and straddles the safety strap 80. The safety walker 10 comprises a movable support frame 20 having a front end 45, left side 50, right side 52 and back end 40. A plurality of frame support members 24 are coupled together to create the moveable support frame 20. The support frame has wheels 32 coupled to the base 30 that enables the support frame to move freely in any direction, as described herein. The top portions of the left and right sides as well as the front end 45 of the support frame provide a hand rail 22 for a person to hold onto and guide the safety walker. There is an opening in the back end to allow a person to easily enter the safety walker. A strap 80 has a length from the fixed end 82, attached to the front end 45, to the actuating end 84, attached to the back end coupler 76 of the pivoting strap mechanism 70. The pivoting strap mechanism has a left strap actuator 71 and a right strap actuator 72 that are rigid members that pivot or rotate about the pivot 73 secured to the movable support frame, as indicated by the large arrow around the pivot 73. The safety strap extends from the front end 45 of the support frame 20 to the back end coupler that extends between the left and right strap actuators proximal the back end of the actuators. As shown, the back end coupler and actuating end of the strap are resting on the floor when the safety walker is in an entry position. The wheel lock actuator 90 is configured to lock the wheels 32 from moving. A cable 94 extends from the wheel lock actuator 92 to engage a break or wheel lock 90 on the wheels, 32, 37.)

Figure 2:
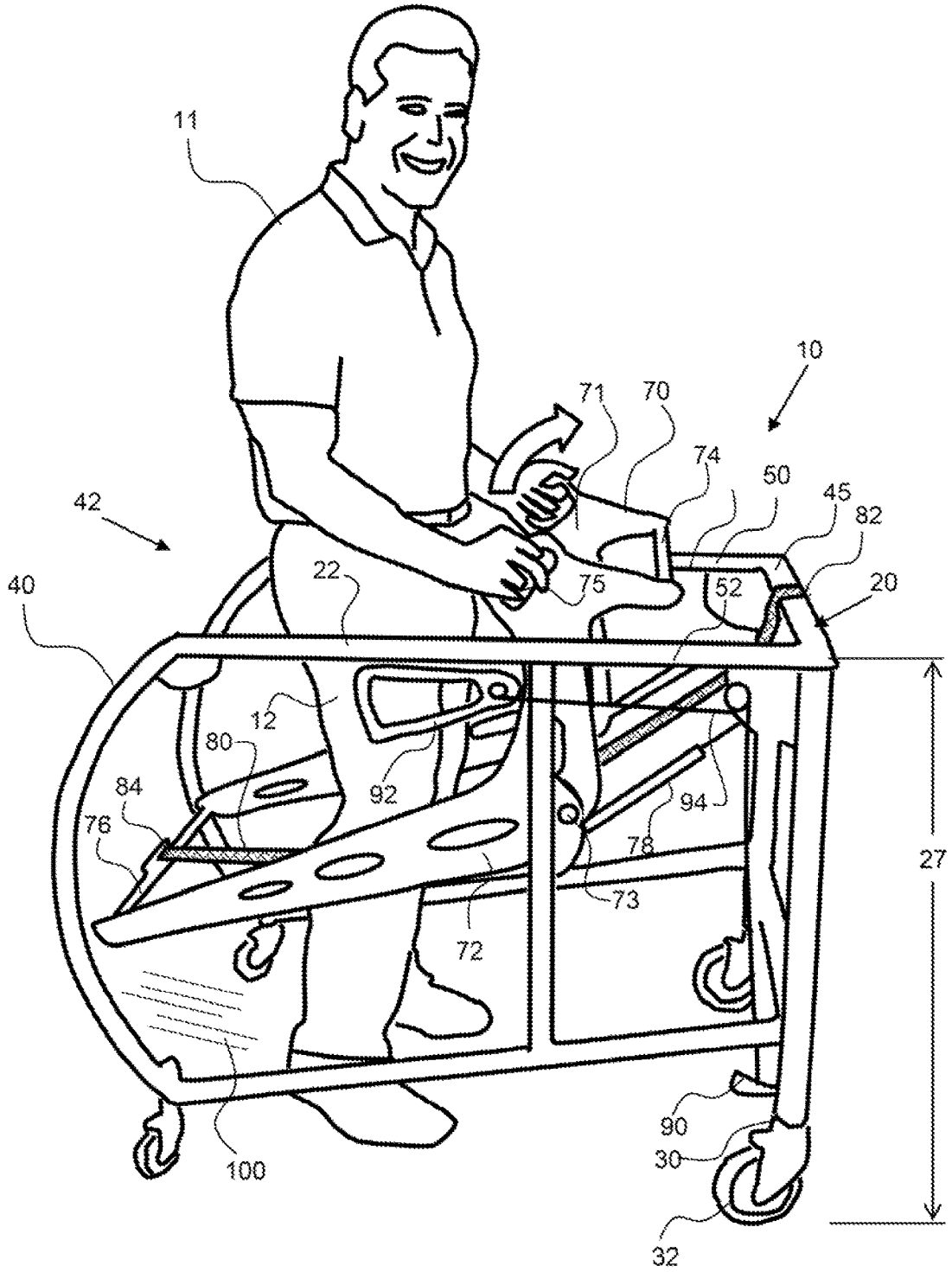
FIG. 2 shows a side view of an exemplary safety walker with a person actuating the pivoting safety strap mechanism forward to raise the actuating end of the safety strap.

As shown in FIG. 2, the person 11 is now within the exemplary safety walker 10 and the strap 80 is extending through the person's legs 12. The pivoting strap mechanism is rotated up from the entry position but is not locked into a secure position. The actuating end 84 of the safety strap 80 as well as the back end coupler 76 are raised off of the floor 100. The left and right strap actuators have handles 75 for the person to hold onto as they pivot the actuators into a secured position, shown in FIG. 3. Dampers 78 are coupled between the left and right strap actuators and the support frame 20 to prevent the strap actuators from dropping and damaging the floor. The height 27 of the safety walker and the height of the top support members or hand rails 22 is suitable for a person to use for assistance as they maneuver the safety walker, as described herein.

Figure 3:
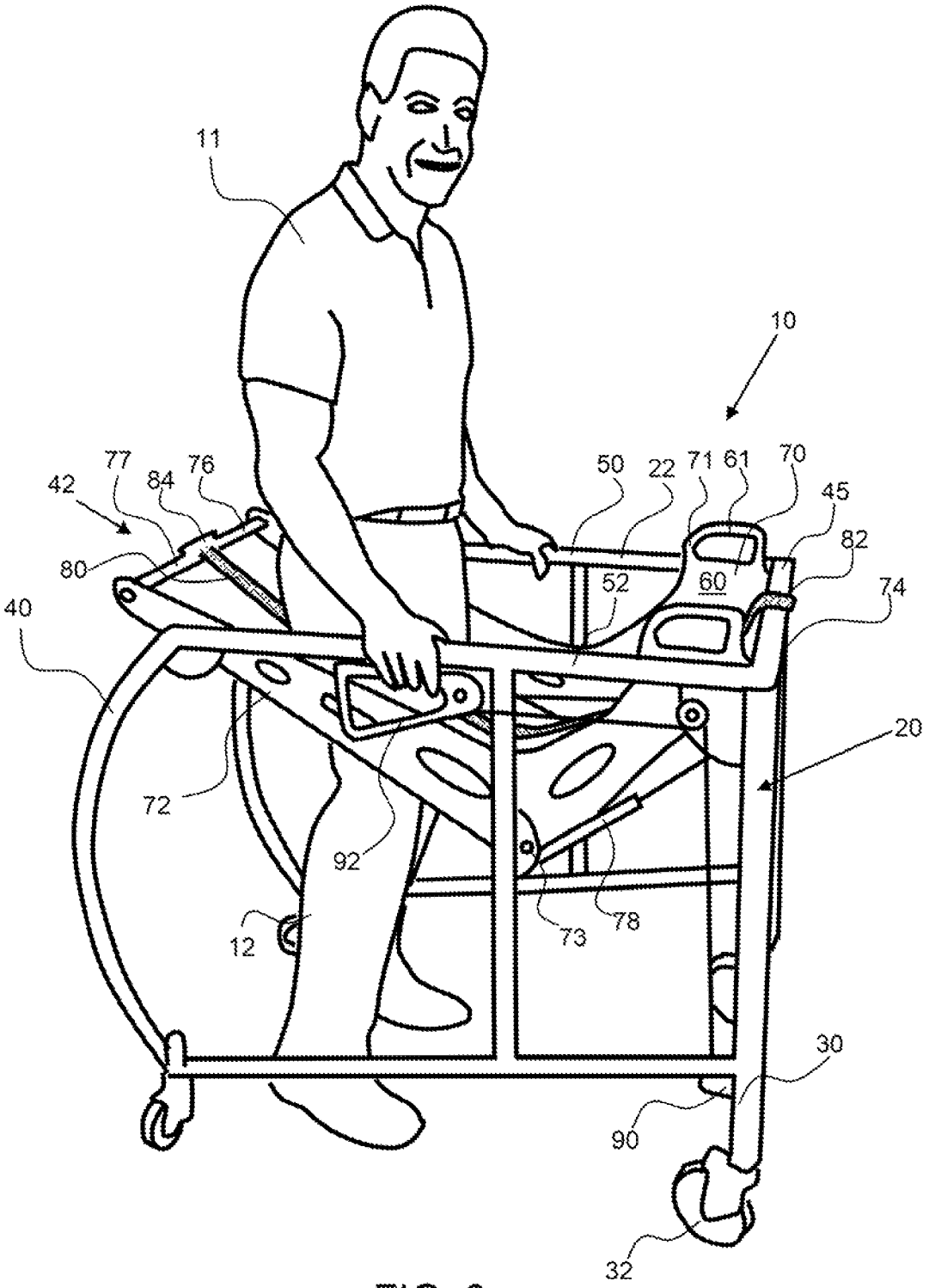
FIG. 3 shows a side view of an exemplary safety walker with a person secured in the safety walker with the pivoting safety strap mechanism locked into a secure position and the safety strap extending from a front end through the person's crotch to the actuating end.

As shown in FIG. 3, the exemplary safety walker 10 is now in a secure position or orientation with the strap actuators 71, 72 pivoted forward until they are locked into position by a latch, not shown. The person can now move the safety walker with the safety strap 80 extending from the front end 45, through their legs 12, to the back end coupler 76 that is now raised off the ground and secured in an elevated position. The wheel lock actuator has been rotated to free the wheel lock and thereby allow free movement of the safety walker.

Figure 4:
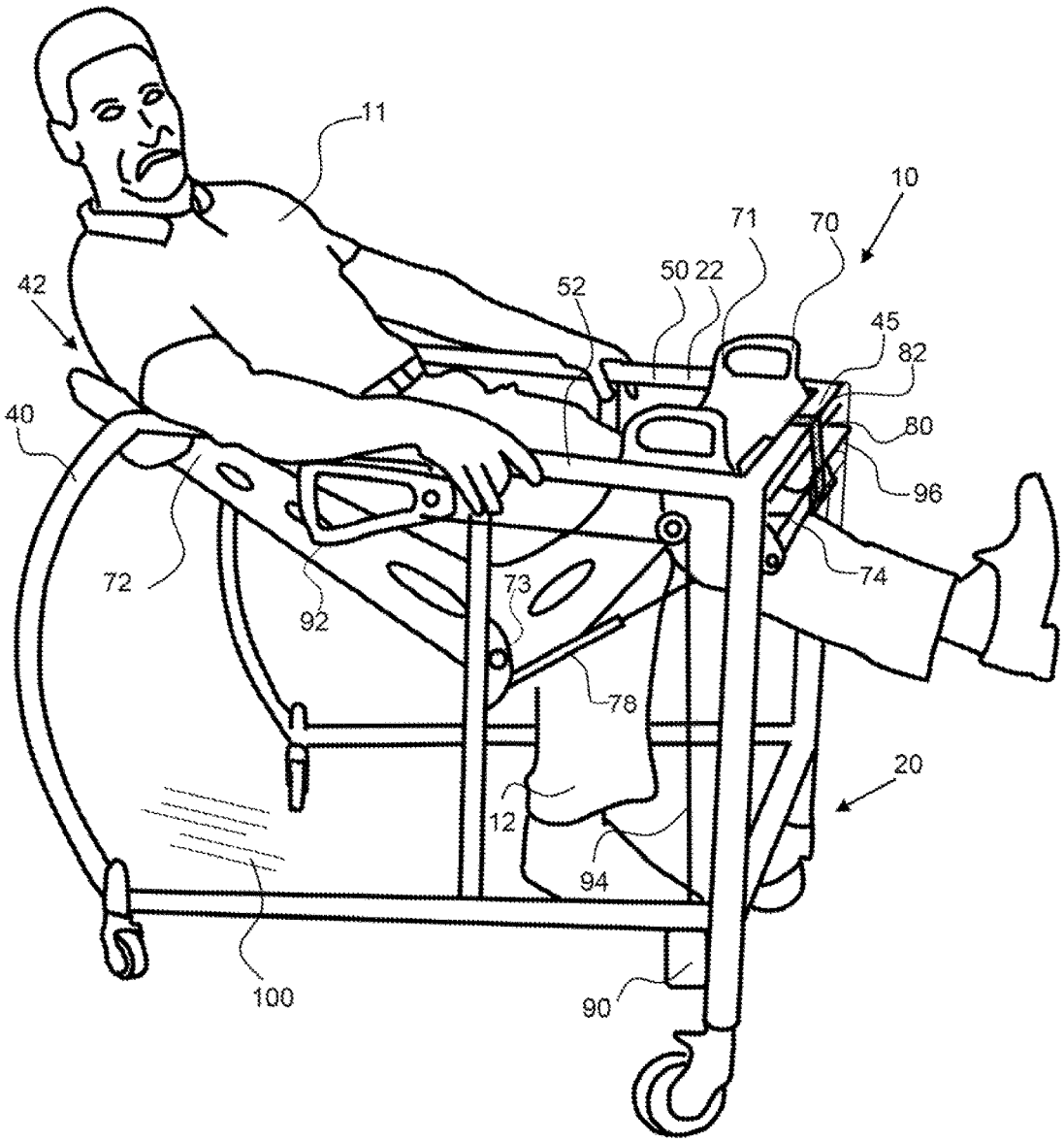
FIG. 4 shows a side view of an exemplary safety walker with a person being secured by the strap after falling.

As shown in FIG. 4, the person 11 has fallen and has been caught by the safety strap extending through their legs 12. The person cannot fall as the strap extends through their crotch and the hand rails 22 prevent them from falling to either side.

Figure 5:
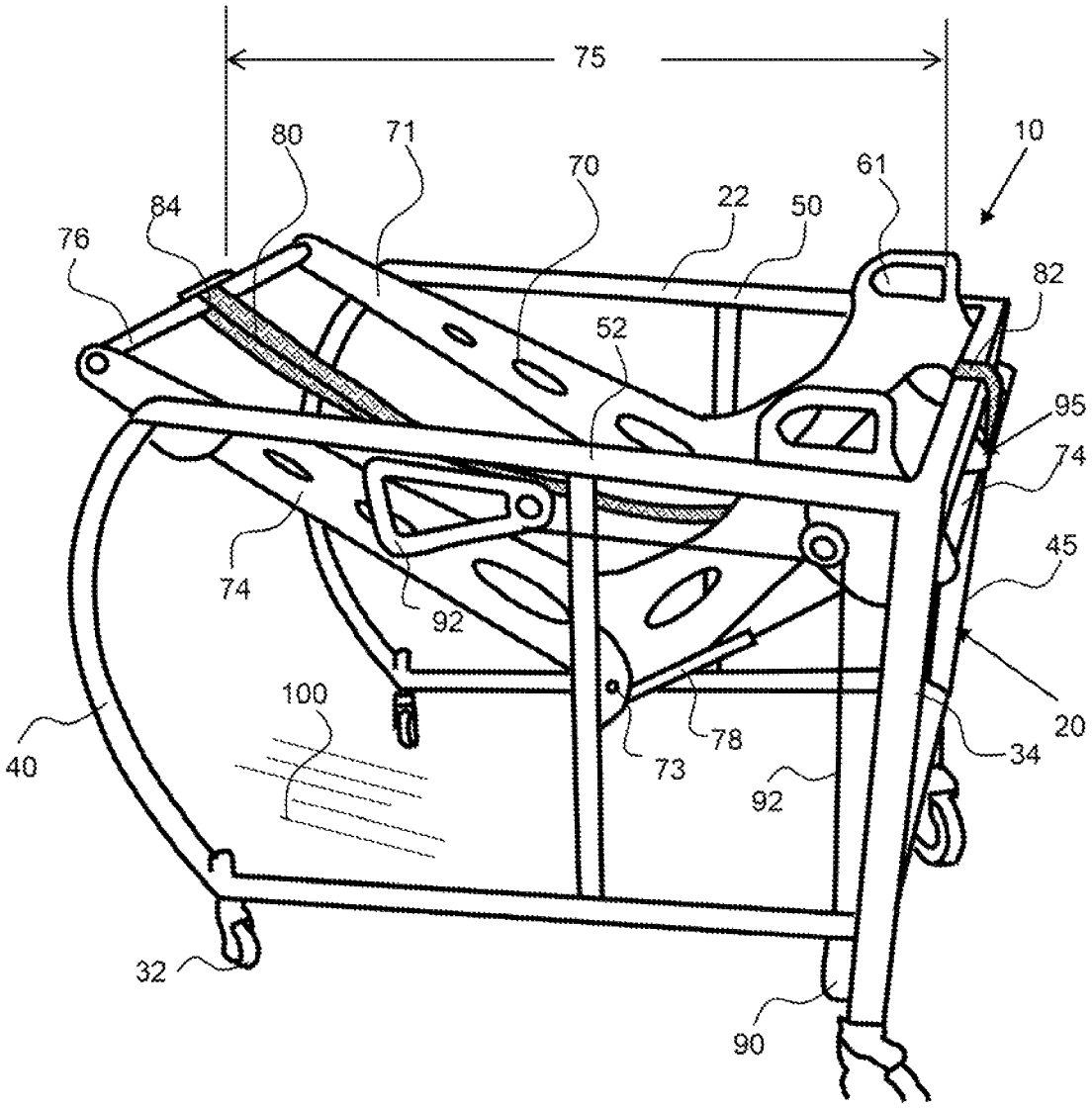
FIG. 5 shows a side view of an exemplary safety walker with the pivoting safety strap mechanism in a secured position.

As shown in FIG. 5, an exemplary safety walker 10 has the pivoting strap mechanism 70 in a secured position. In this exemplary embodiment, the front end coupler 74, a bar extending between the left and right strap actuators, is retained in position by an actuator lock mechanism 95. A latch of the actuator lock mechanism may deflect as the strap actuator is rotated forward to engage with the front end coupler to retain it in position. As shown in FIG. 5, the safety strap 80 is elevated from the floor. The front end 82 is secured to the support frame 20 and the back end, or actuating end 84, is coupled with the back end coupler 76. The length of the strap actuator 75 from the back end coupler to the handle 61 is shown.

Figure 6:
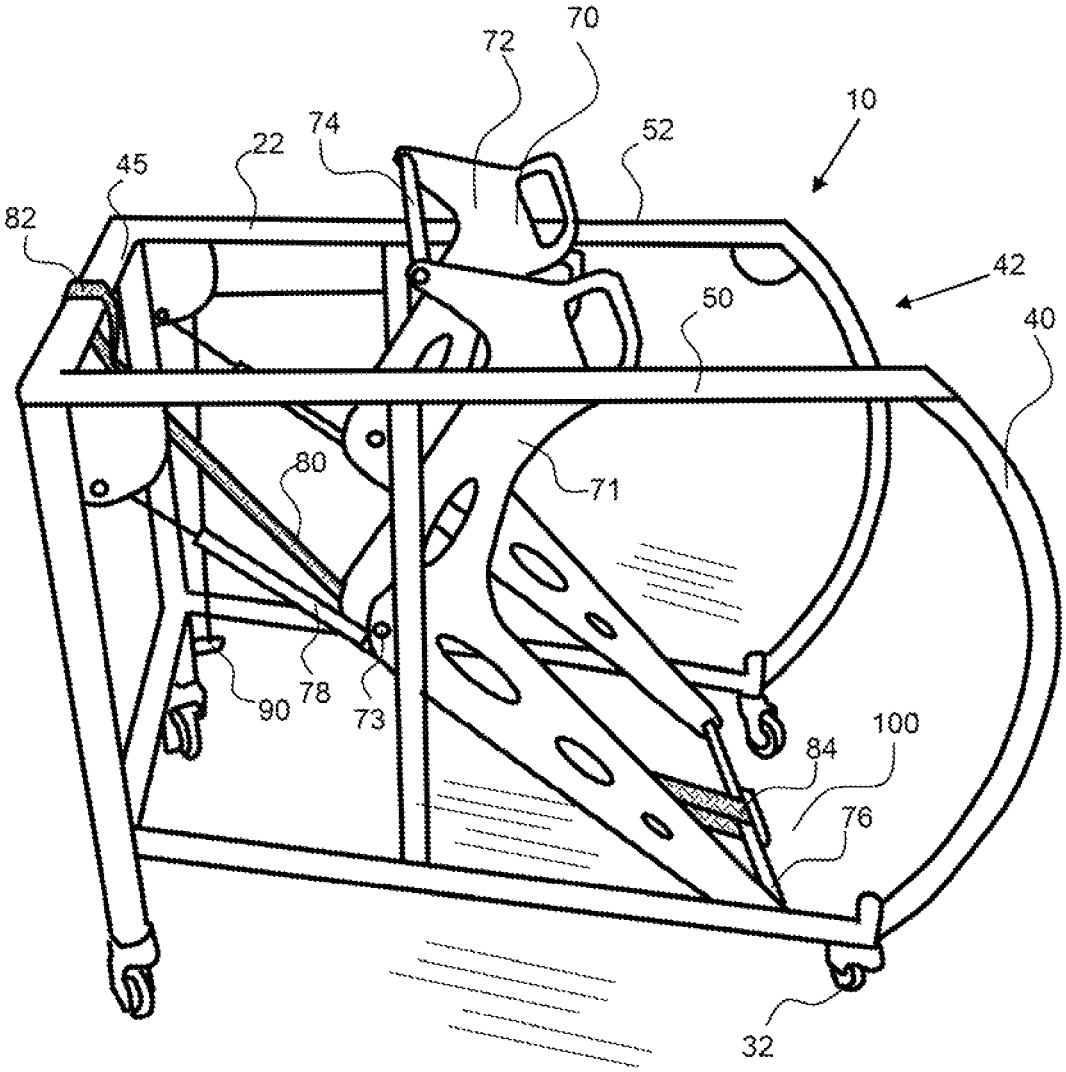
FIG. 6 shows a side view of an exemplary safety walker with the pivoting safety strap mechanism in entry position, wherein the actuating end of the strap and back end coupler are resting on the floor.

As shown in FIG. 6, an exemplary safety walker 10 has the pivoting safety strap mechanism 70 in an entry position, wherein the actuating end 84 of the safety strap 80 and the back end coupler 76 are resting on the floor 100. This allows a person to easily step over the back end coupler and straddle the safety strap 80. The person can then actuate the pivoting safety strap mechanism 70 by rotating it forward and about the pivot 73 until it latches automatically into a secure position. The person can then freely move with the walker in any position by grasping the hand rails 22 and pushing the safety walker 10.

Figure 7:
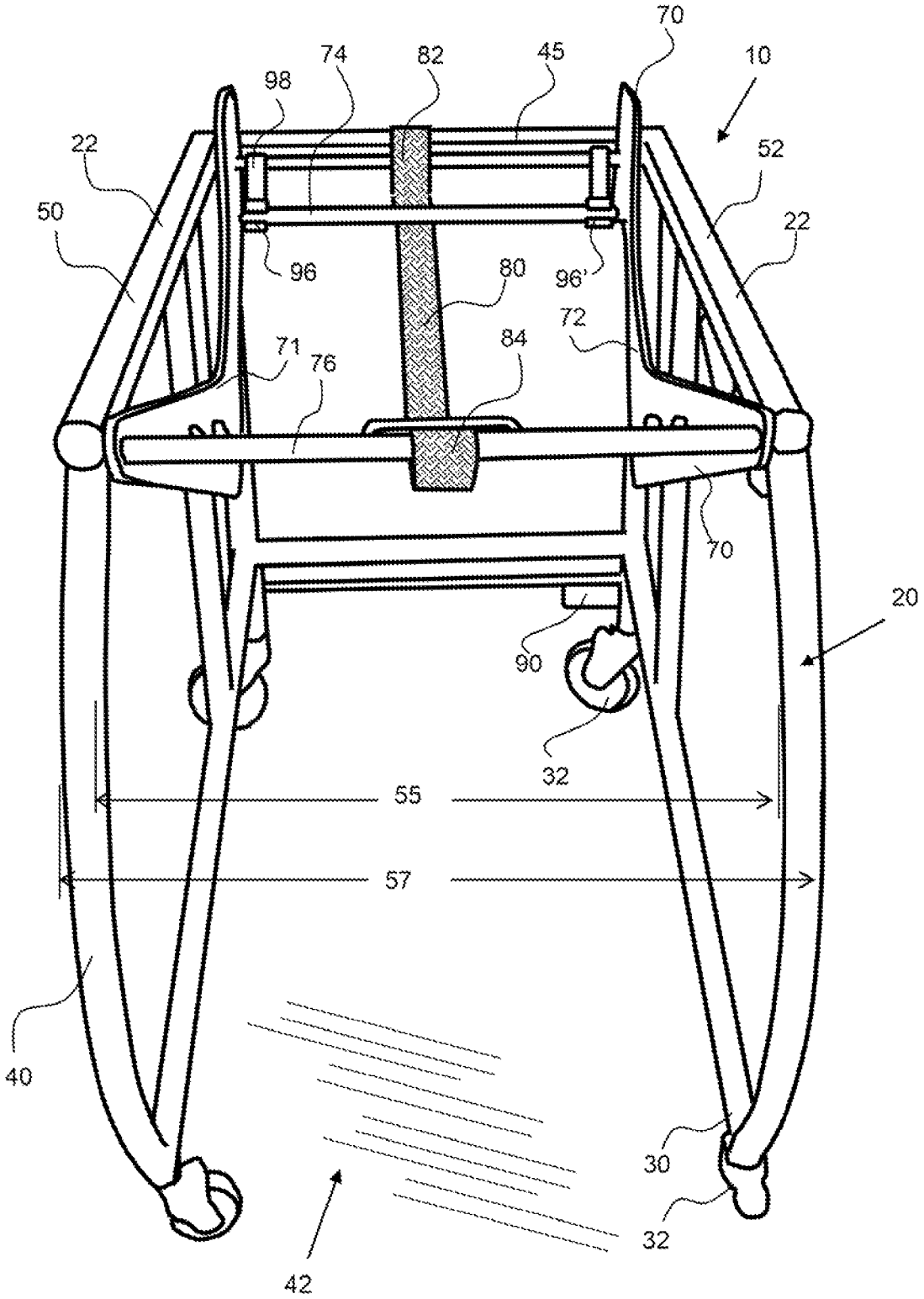
FIG. 7 shows a back end view of an exemplary safety walker with the pivoting safety strap mechanism in a secured position.

As shown in FIG. 7, an exemplary safety walker 10 is in a secure position with the pivoting safety strap mechanism 70 retained in a secured position by the latch 96. The latch has two extensions from a latch actuator 98 that extends around the front end coupler 74 when it is pushed down into the secure position. The latch extensions may be spring loaded or may fall into place to secure the actuator by gravity. The width 55 between the left and right sides, or entry opening width, as well as the outer width 57 of the safety walker, or the movable support frame, are shown.

Figure 8:
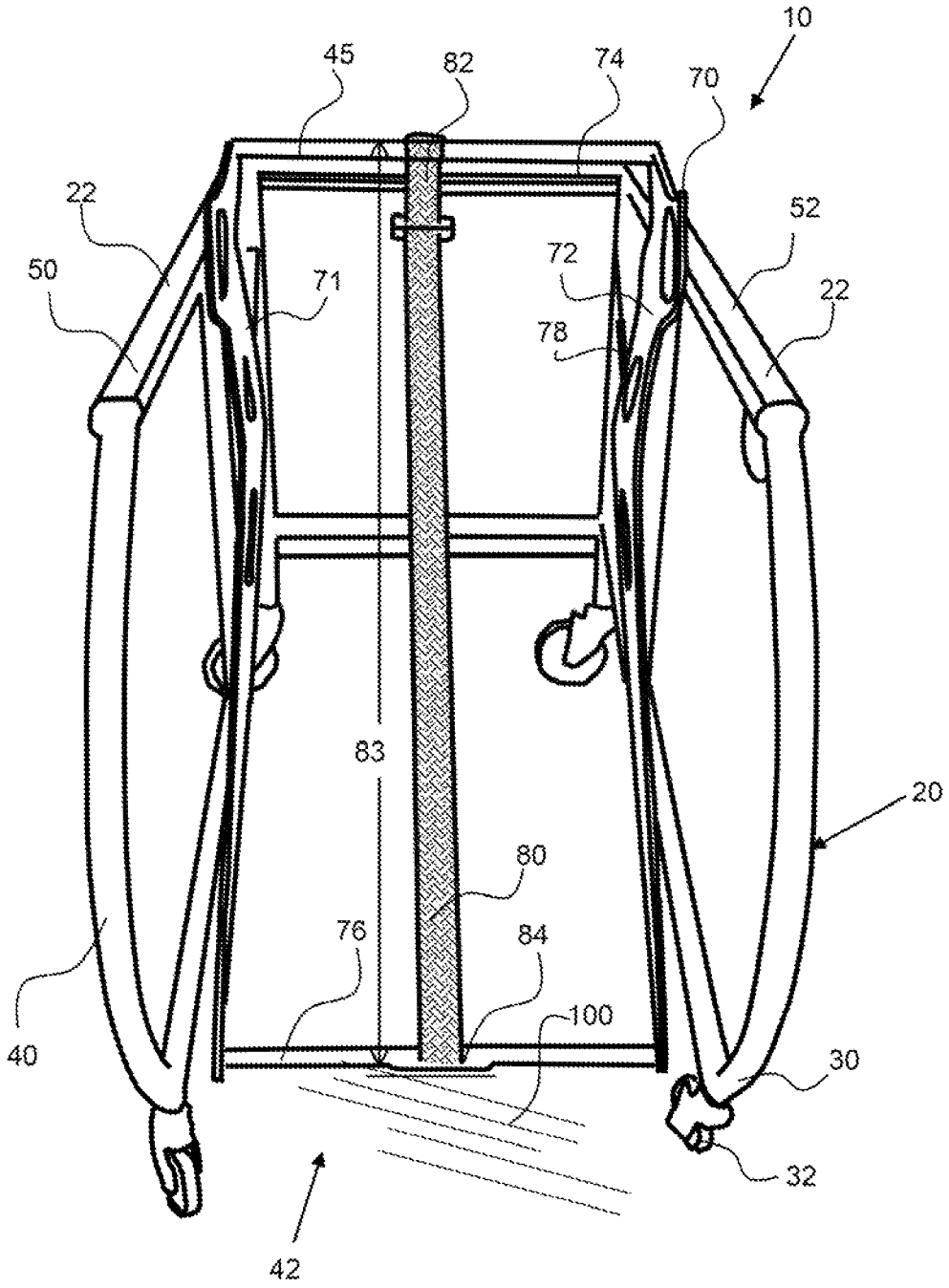
FIG. 8 shows a back end view of an exemplary safety walker with the pivoting safety strap mechanism in entry position, wherein the actuating end of the strap and back end coupler are resting on the floor.

As shown in FIG. 8, an exemplary safety walker 10 is in an entry position with the pivoting safety strap mechanism 70 dropped down. The actuating end of the strap 84 is secured to the back end coupler 76 that is resting on the floor 100. The back end coupler may have a flat profile making it easy for a person to step over the back end coupler and into the safety walker. The length 83 of the safety strap 80 is shown. As described herein, the safety walker may provide effective fall prevention without requiring adjustment of the strap length between the front end 45 and the back end coupler 76.

Figure 9:
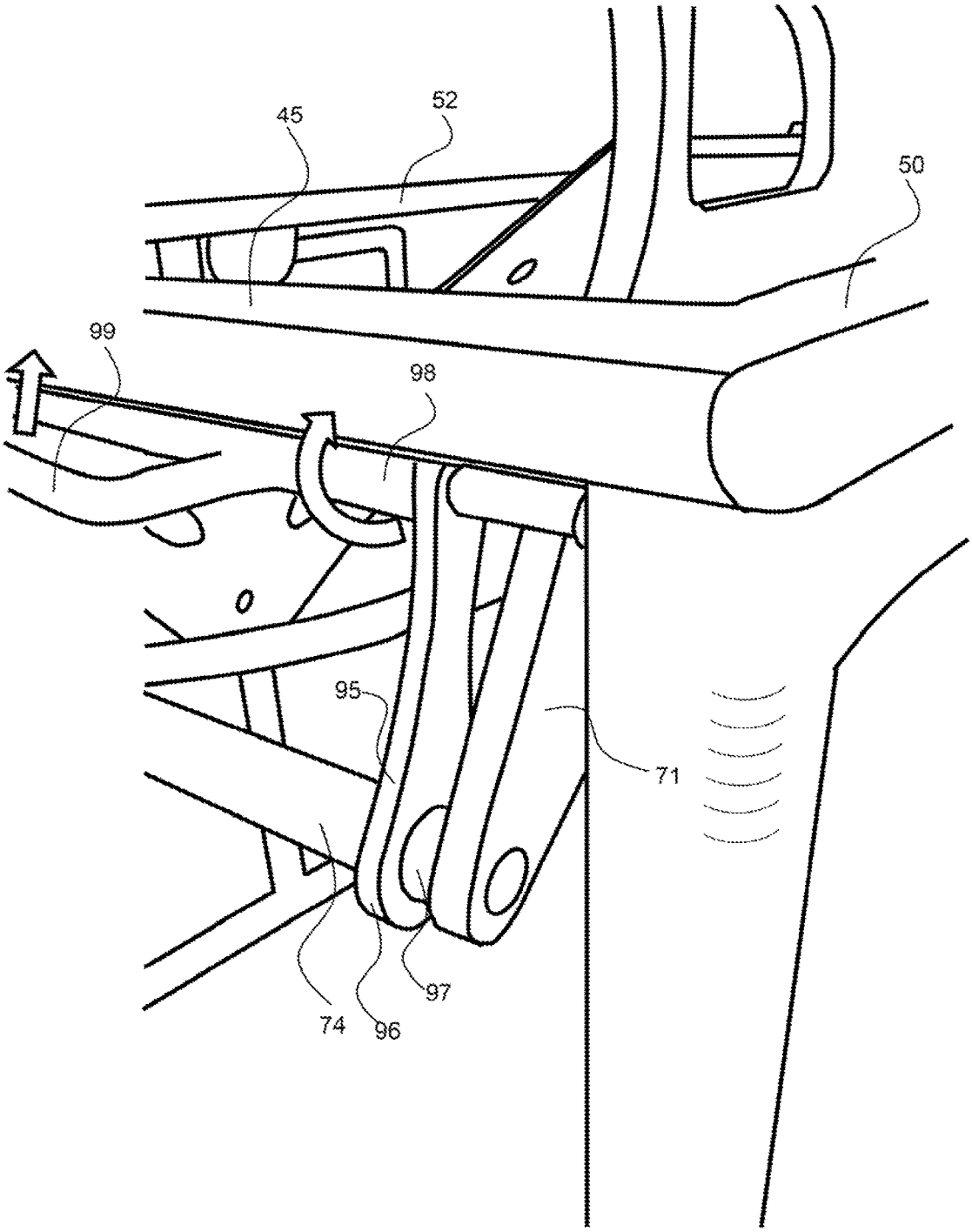
FIG. 9 shows a perspective view of the latch actuator and latch that secures the pivoting strap mechanism in a secure position.

As shown in FIG. 9, an exemplary actuator lock mechanism 95 comprises a latch actuator 98 and latch 96 that secure the front end coupler 74 into a secure position. The front end coupler will hit the latch 96 and deflect it until the opening in the latch 97 seats around the front end coupler 74. A latch actuator 99 allows a person to release the latch by pulling up on the latch actuator which rotates the latch or latches from engagement with the front end coupler.

Figure 10:
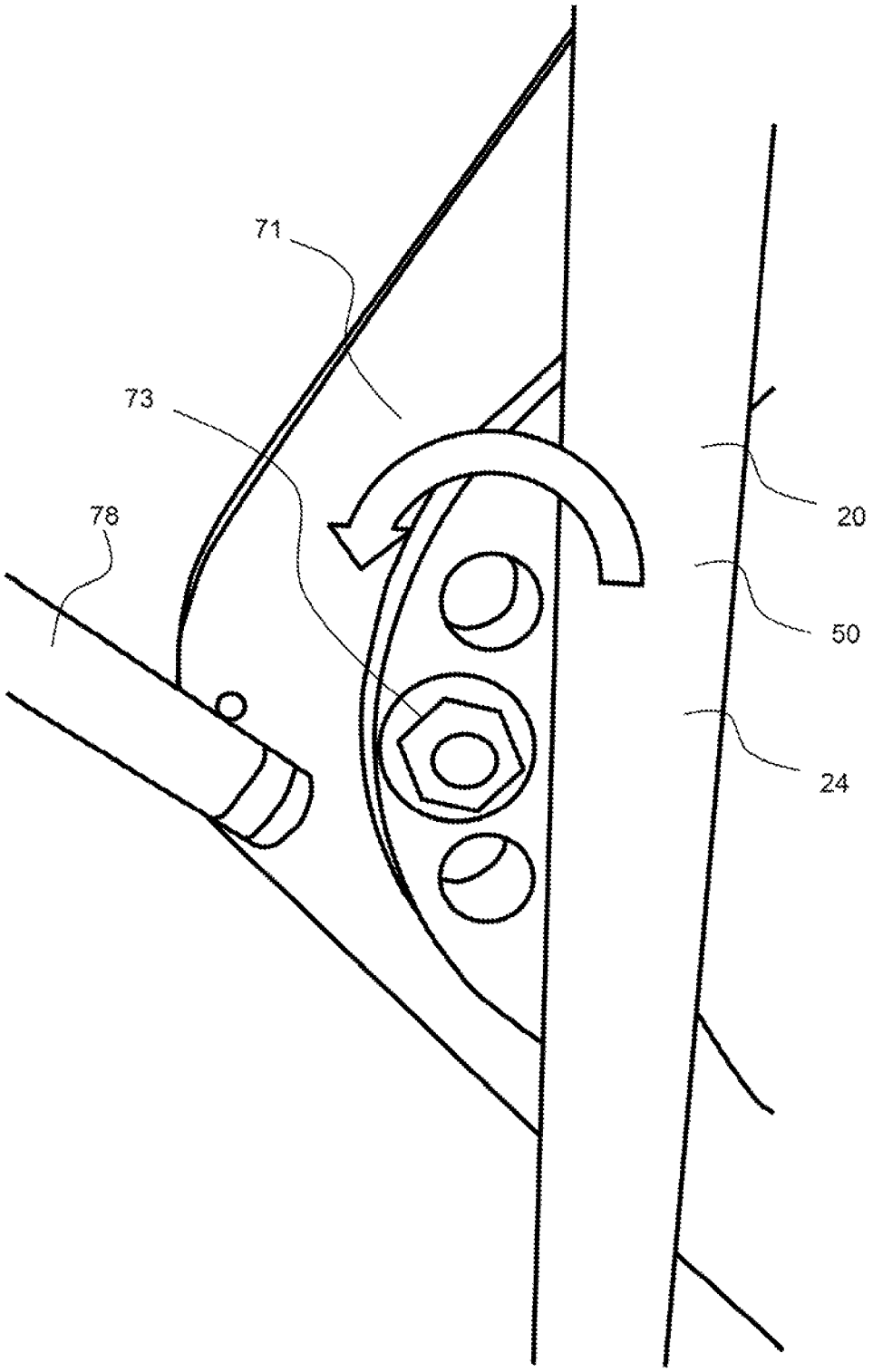
FIG. 10 shows a perspective view of a portion of the left side of the support frame having a pivot that couples with the left strap actuator.

As shown in FIG. 10, a damper 78 is attached to the left strap actuator 71. The left strap actuator 71 is coupled to the movable support frame 20 on a left side 50 support member 24. The strap actuator 71 is configured to rotate about the pivot 73 forward and backward. Forward rotation to engages the strap actuator lock mechanism and secures the strap actuator in a secure position. Backward rotation positions the actuating end of the strap and the back end coupler proximal to the floor.

Figure 11:
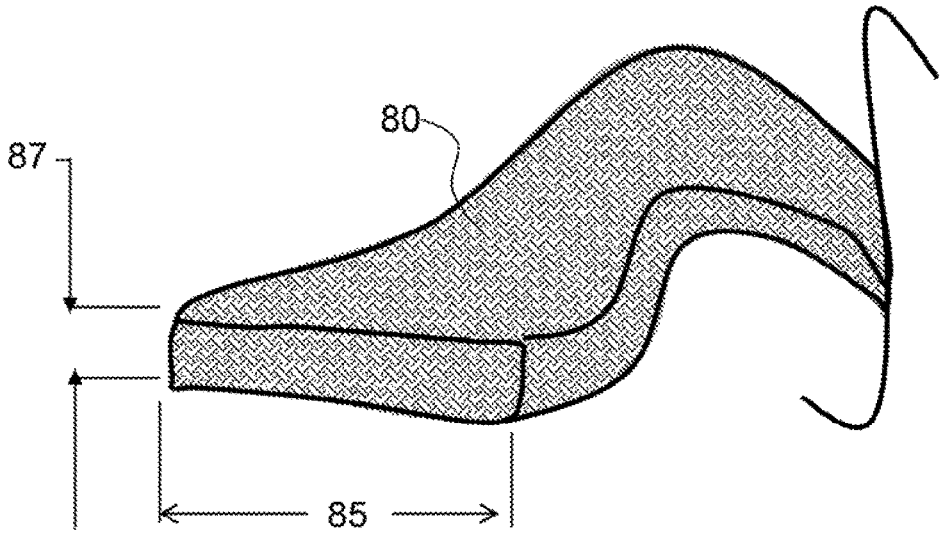
FIG. 11 show s perspective cross section of an exemplary strap.

As shown in FIG. 11, an exemplary strap 80 has a width 85 and thickness 87, as described herein. The width of the strap may be suitably narrow to reduce interference with walking and sufficiently wide enough to secure the person in the event of a fall. As described herein, the thickness of the strap may be sufficiently thin to allow easy entry into the safety walker.

Figure 12:
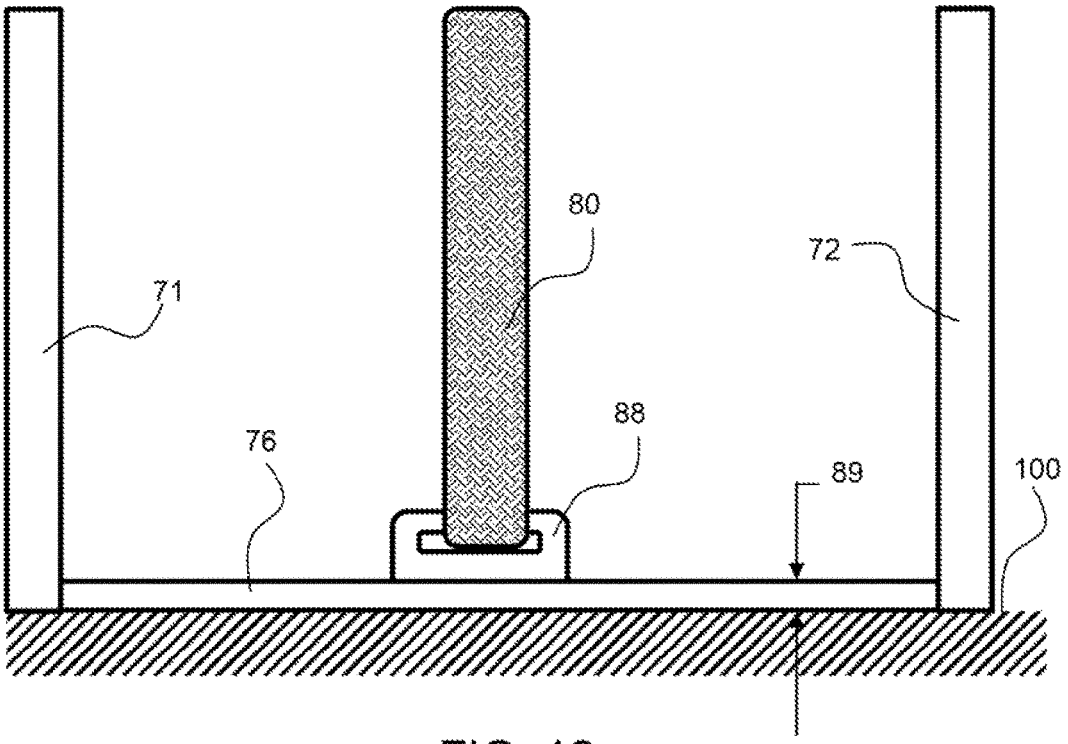
FIG. 12 shows the back view of a portion of the safety walker in an entry position with the back end coupler on the floor.

As shown in FIG. 12, the safety strap 80 may be coupled with an extension portion 88 of the back end coupler 76 to reduce the height of the back end coupler from the floor when in an entry position. The back end coupler may have a thickness 89 that is sufficiently small to allow easy entry into the safety walker.

Figure 13:
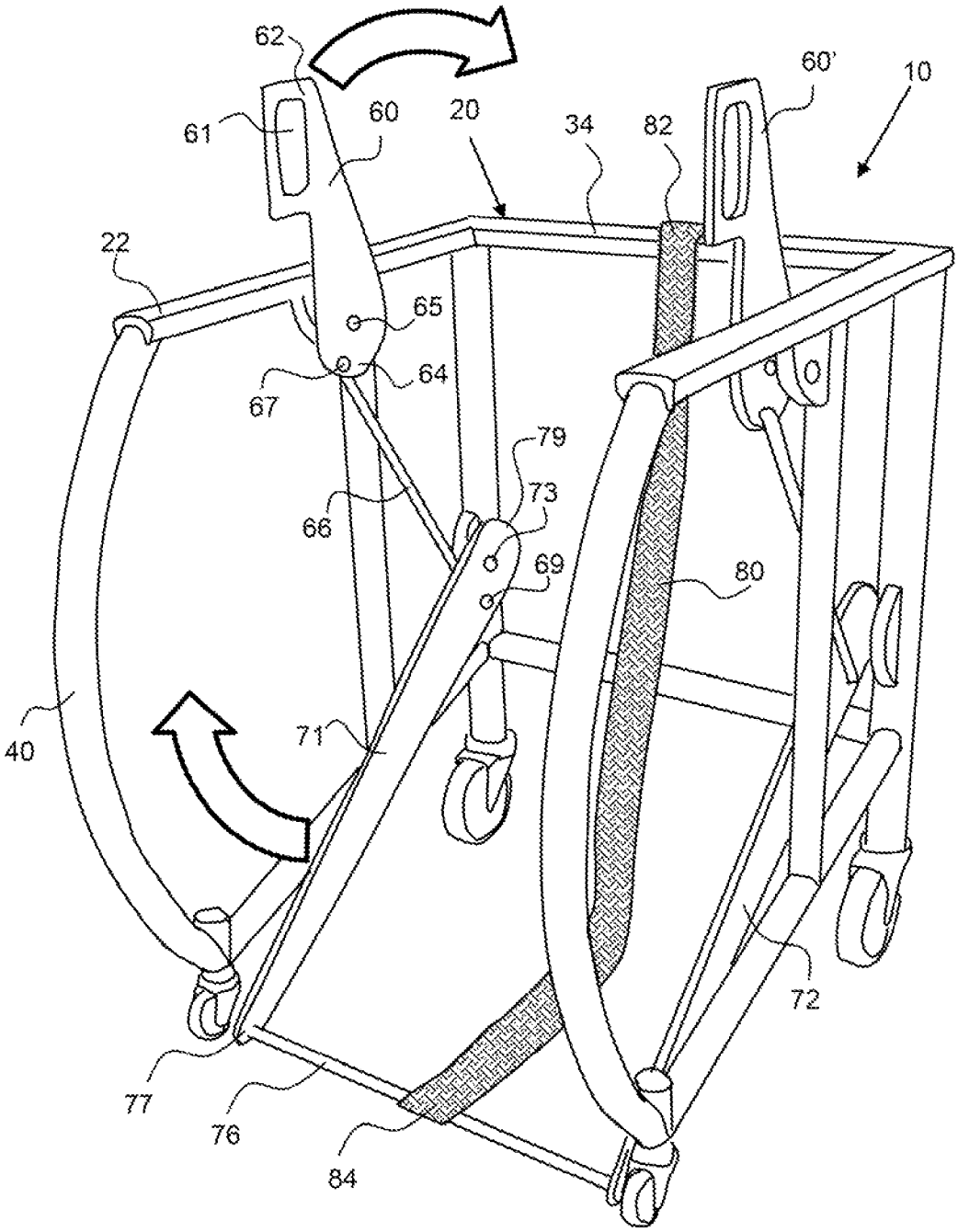
FIG. 13 shows a back-end perspective view of an exemplary safety walker with a handle actuator coupled to a strap actuator by a linkage and the entry end of the strap actuator in a down position, or proximal to the floor.

As shown in FIG. 13, of an exemplary safety walker 10 is configured with a handle actuator 60 coupled to a strap actuator 71 by a linkage 66. The handle actuator 60 has a handle 61, and a length from a handle end to a pivot end 64. The handle actuator pivots or rotates about the handle actuator pivot 65 and thereby moves the linkage 66. The linkage 66 may be a rigid linkage, such as a rod, or strut, or may be a flexible linkage, such as a cable, or wire, for example. The linkage has a length and extends from the handle-end 67 to the strap-actuator end 69. Actuation of the handle actuator 60 about the handle actuator pivot 65, as indicated by the bold arrow, pulls the strap actuator 71 up through the linkage. The linkage is attached to the handle actuator at an offset distance from the handle actuator pivot and from the strap actuator pivot 73. The strap actuator has a length and extends from the pivot end to the entry end 77. The linkage pulls the strap actuator and causes it to rotate about the strap actuator pivot 73, as indicated by the bold arrow, thereby raising the actuating end of the strap. The strap 80 extends from the front end 34 of the movable support frame 20 to the actuating end 84 that is coupled to the back-end coupler 76. The back-end coupler extends between the left strap actuator 71 and right strap actuator 72.

Figure 14:
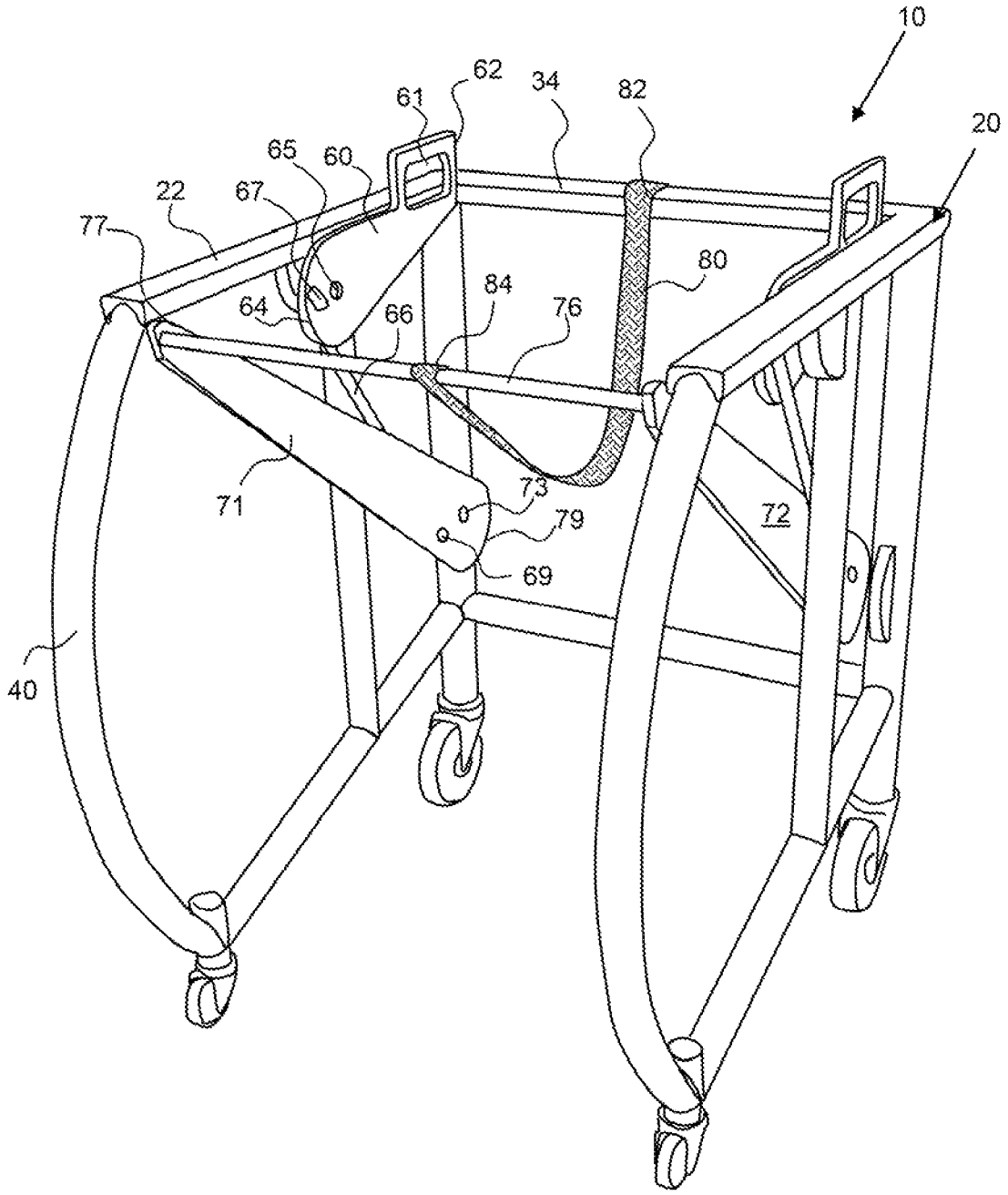
FIG. 14 shows a back-end perspective view of an exemplary safety walker with a handle actuator coupled to a strap actuator by a linkage and the entry end of the strap actuator in an up position, or in a secure position.

As shown in FIG. 14, the exemplary safety walker 10 shown in FIG. 13 is now configured in a secure position, wherein the actuating end 84 of the strap 80 is elevated and locked into place. The handle actuator 60 has been rotated forward toward the front end 34 of the movable frame 20 and is locked into position. This secures the strap actuator in position.

Figure 15:
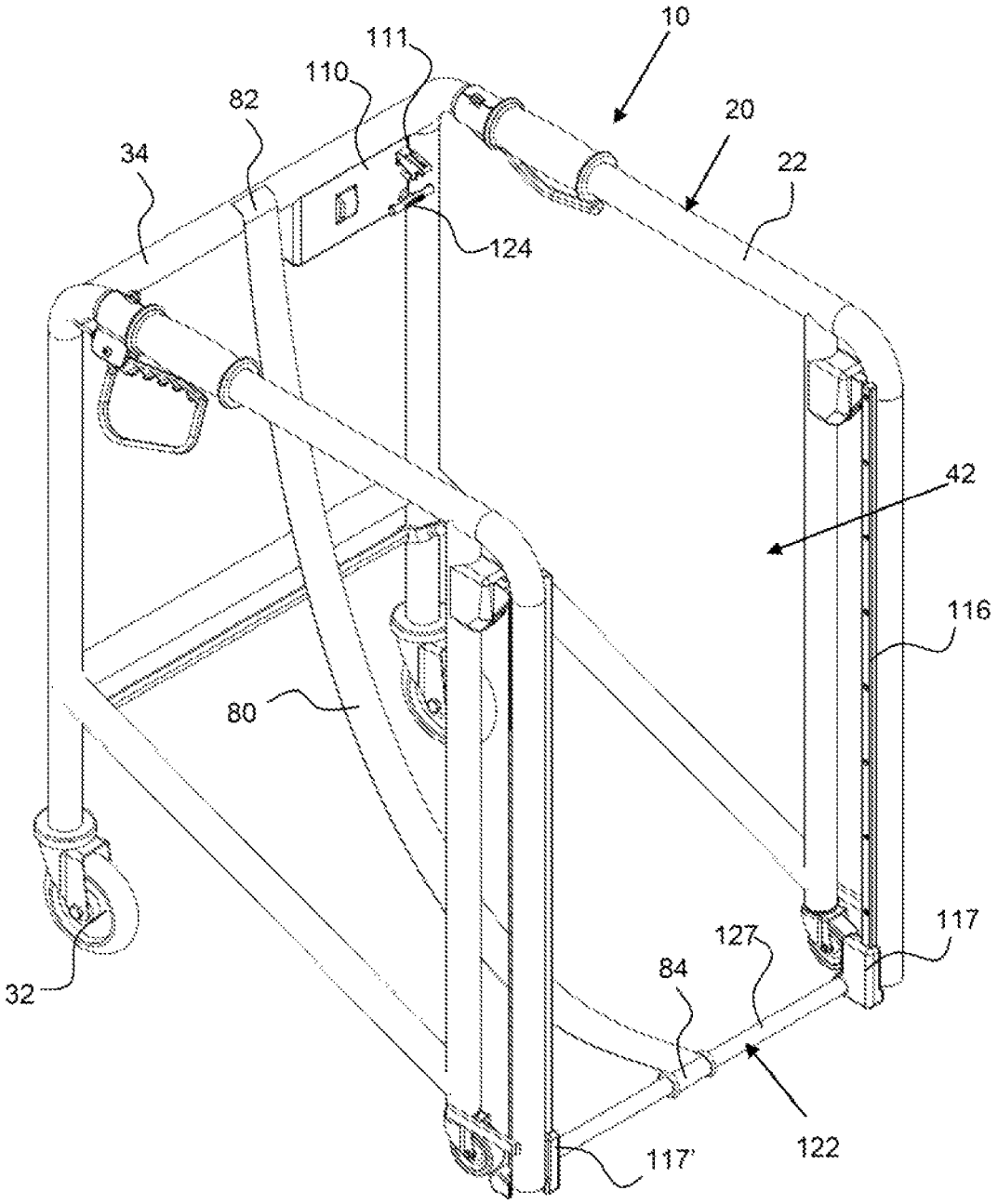
FIG. 15 shows a perspective view of an exemplary safety walker with motorized actuator system that raises and lowers a strap-bar by cables that extend from an actuator interface.
Figure 16:
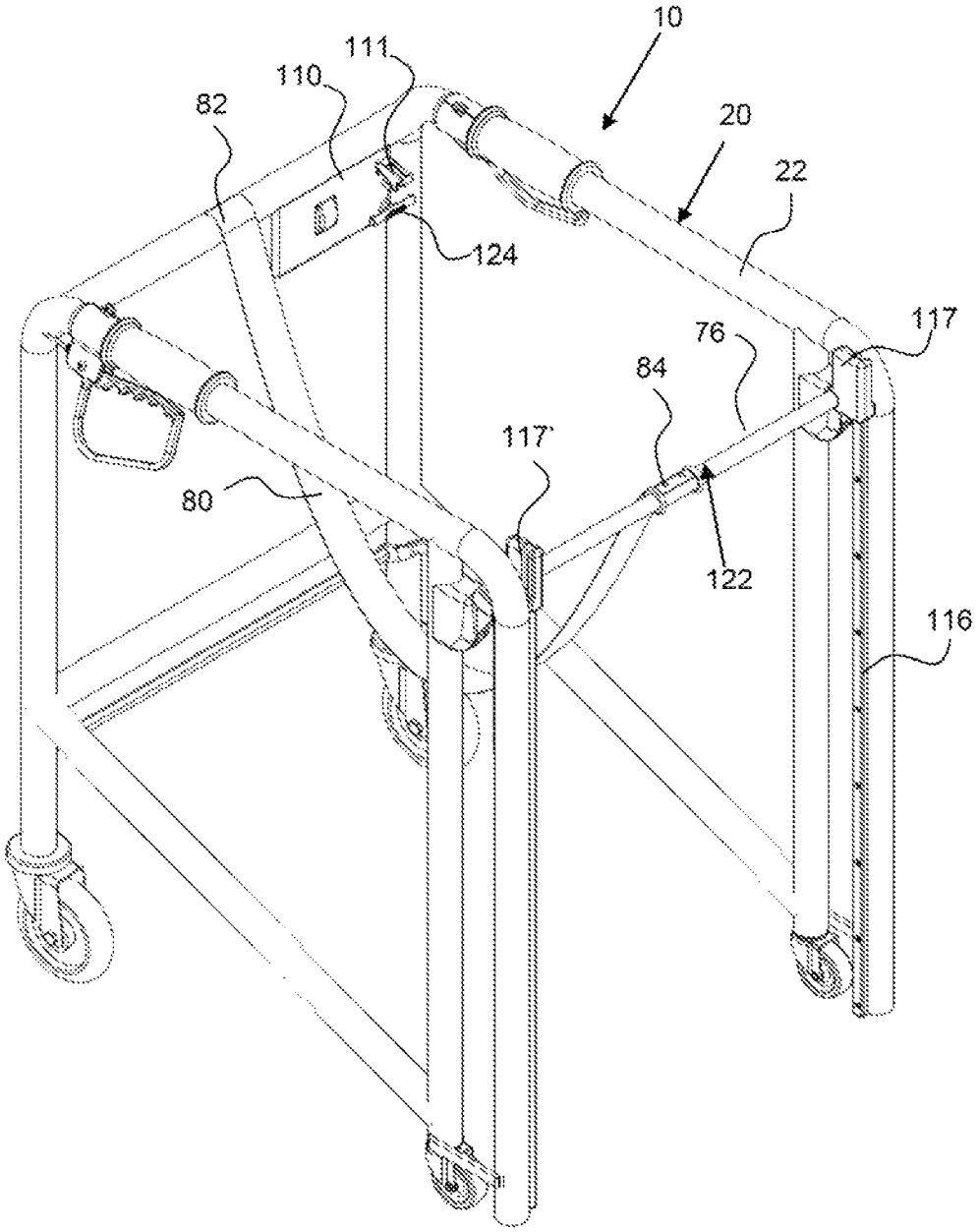
FIG. 16 shows the exemplary safety walker shown in FIG. 15 with the strap-bar in an up position.
Figure 17:
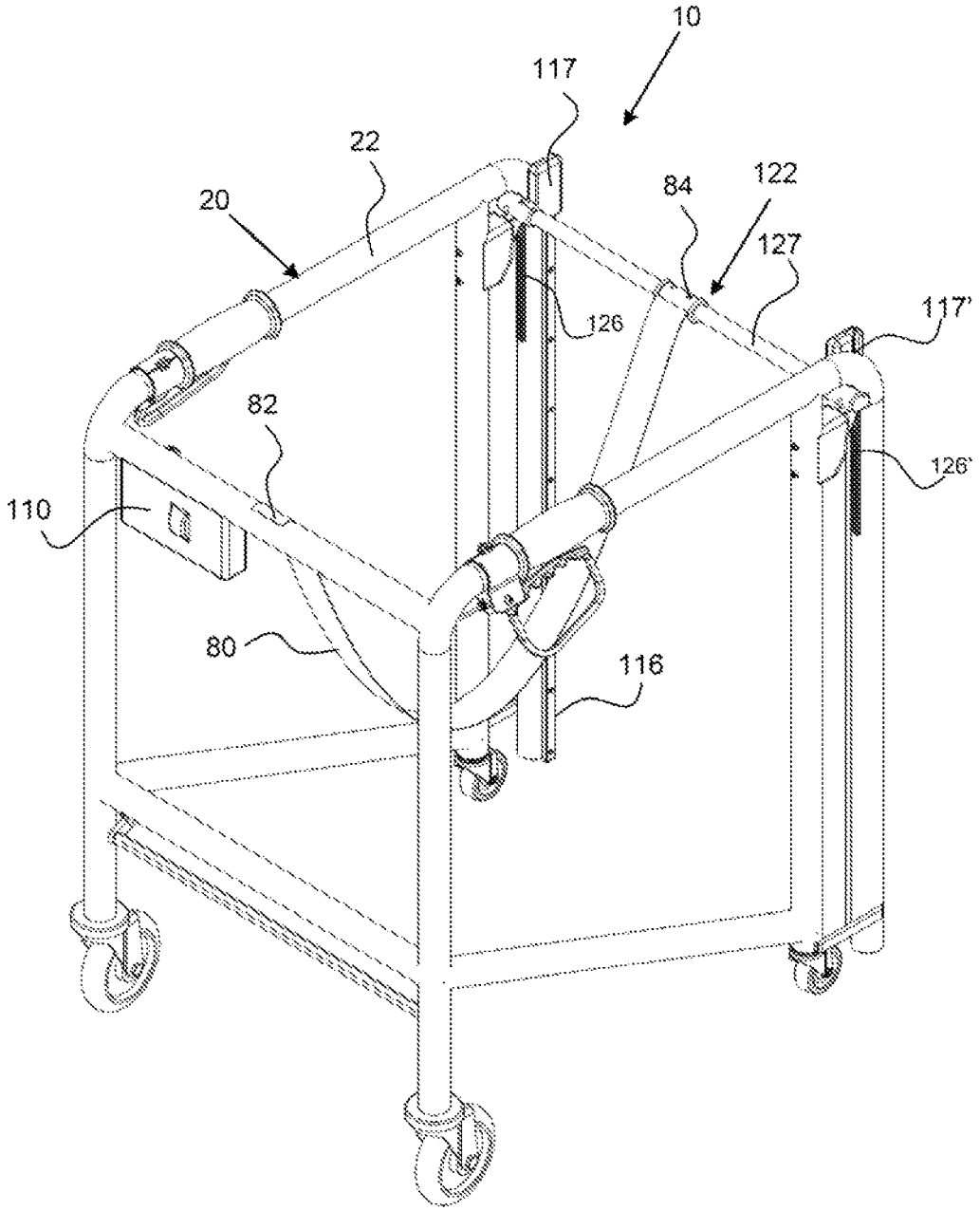
FIG. 17 shows a front perspective view of the exemplary safety walker shown in FIG. 18, with the strap-bar in an up position.
Figure 18:
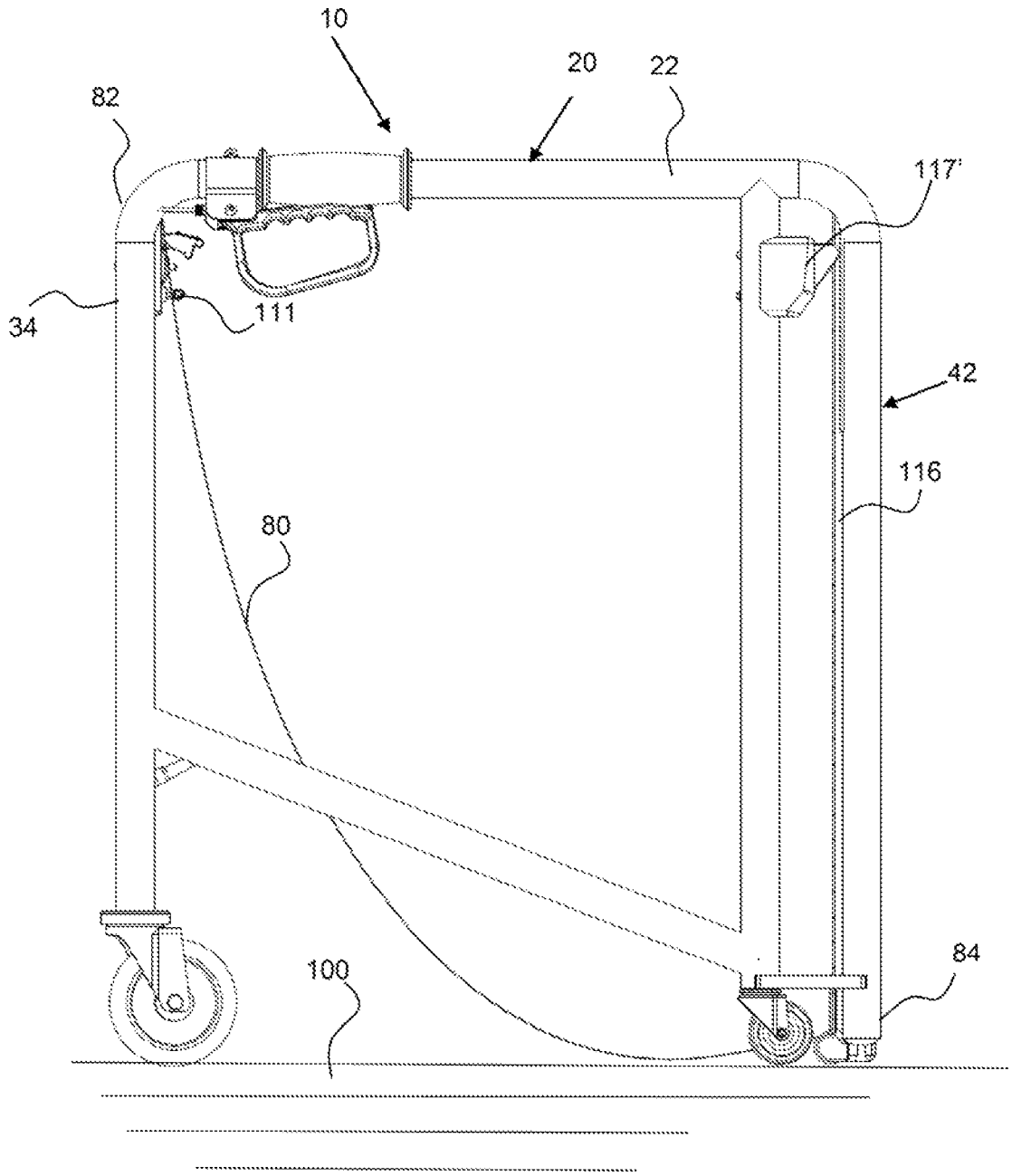
FIG. 18 shows a side view of the exemplary safety walker shown in FIG. 15, with the strap-bar in a down or entry position.
Figure 19:
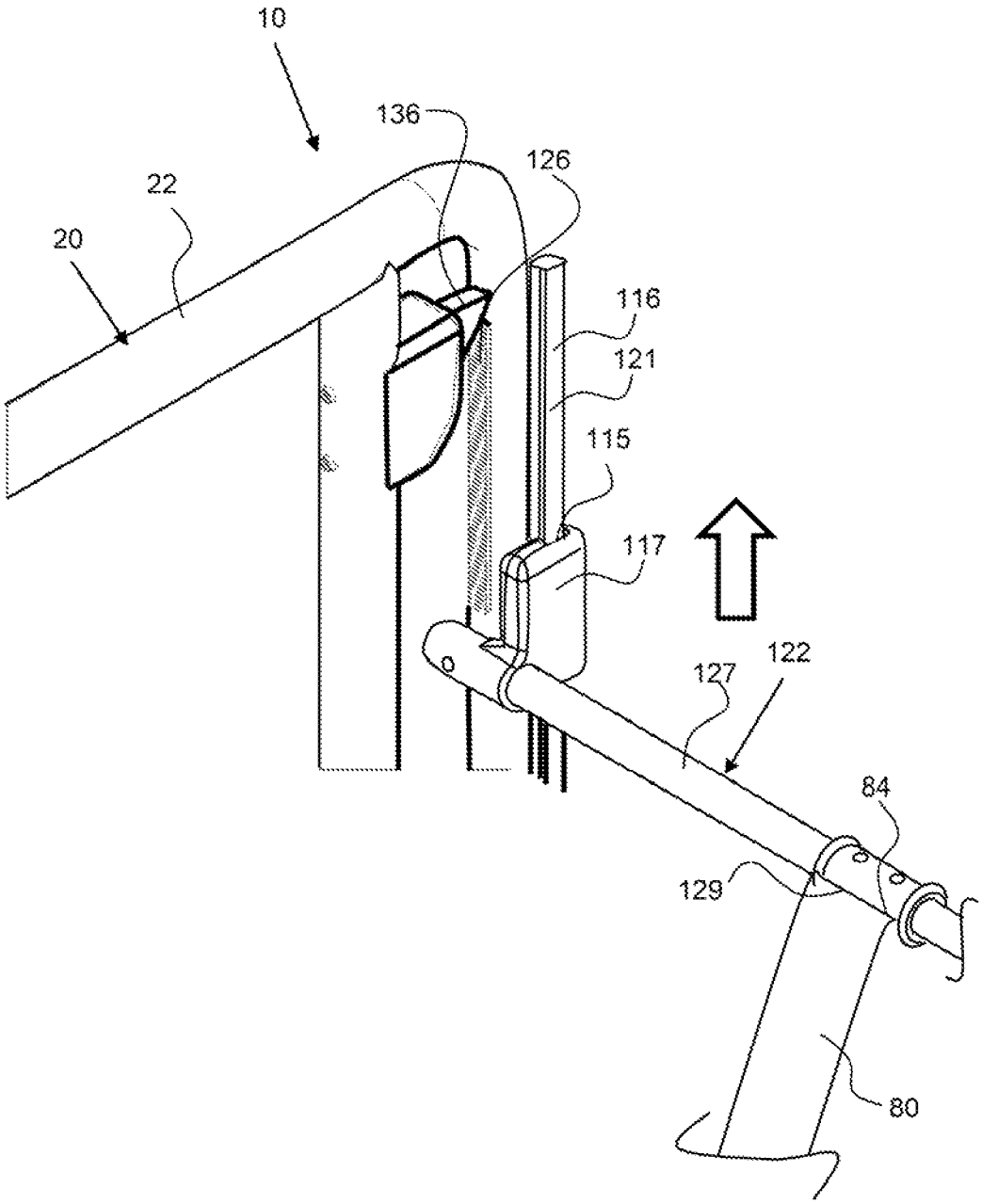
FIG. 19 shows a portion of the exemplary motorized actuator system shown in FIG. 15, with the strap-bar in an intermediate position proximal and secure position with the strap still having slack.
Figure 20:
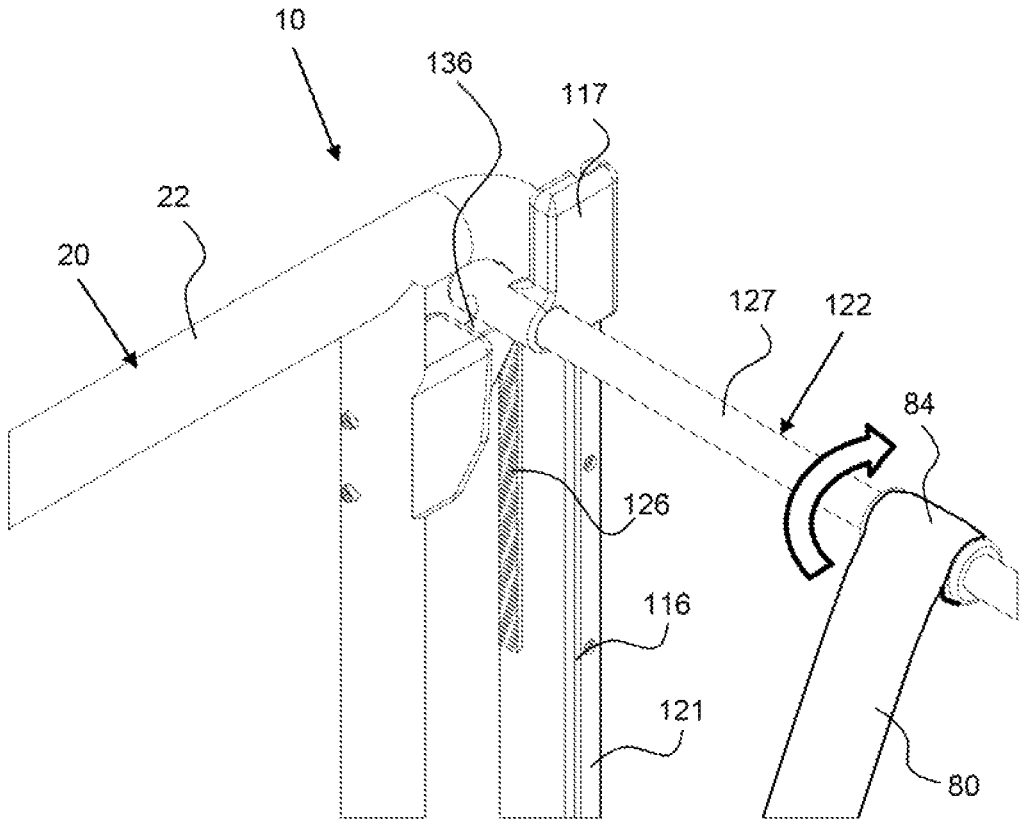
FIG. 20 shows a portion of the exemplary motorized actuator system shown in FIG. 15, with the strap-bar in an up position and the strap wound around the strap-bar to take up slack in the strap.
Figure 21:
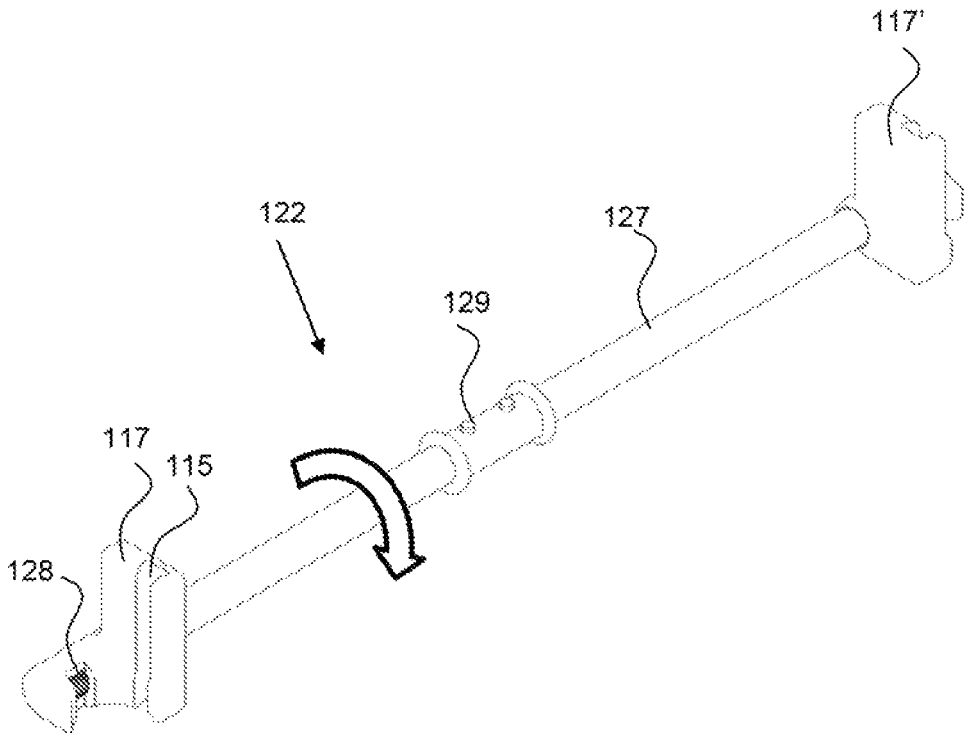
FIG. 21 shows a perspective view of an exemplary strap-bar.
Figure 22:
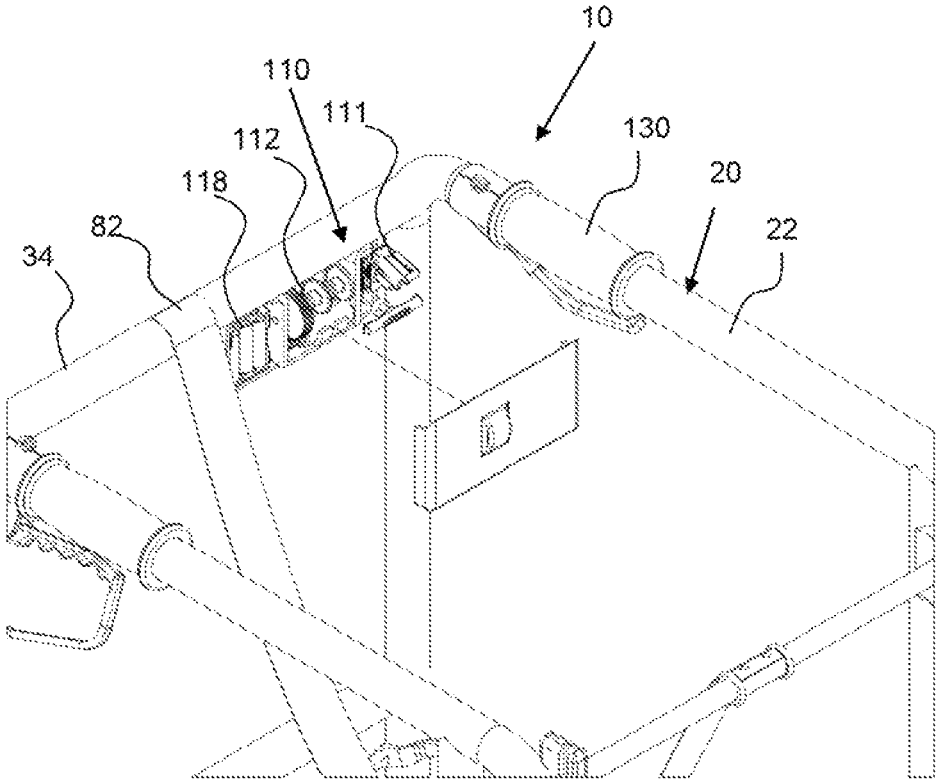
FIG. 22 shows a perspective view of the exemplary safety walker shown in FIG. 15 with the cover to the actuator interface removed.
Figure 23:
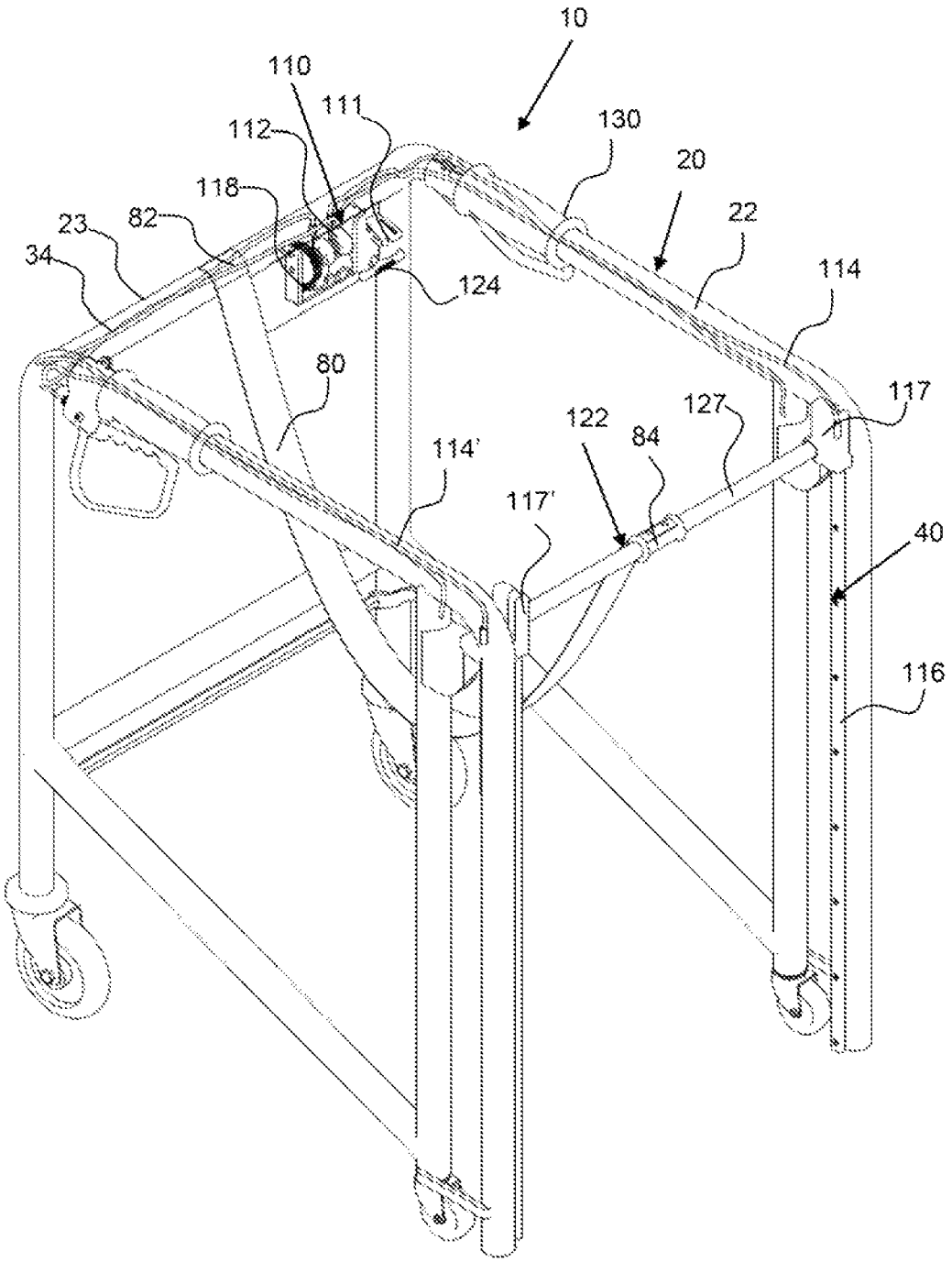
FIG. 23 shows a perspective view of the exemplary safety walker shown in FIG. 15, with the cables shown extending at least partially through the moveable support frame.

Referring now to FIGS. 15 to 23, an exemplary safety walker 10 comprises an actuator system 110 that is motorized to raise and lower a strap-bar 127 by cables that extend from an actuator or user interface 111. The strap-bar 127 has railing couplers 117, 117' that couple the strap-bar to an actuator rail 116. The strap-bar is lifted by cables that are driven by an actuator motor 112. As shown in FIG. 15, the strap-bar is in a down or entry position, with the strap-bar proximal to or resting on the floor. A user simple enters through the back-end opening 42 and then activates the strap-bar by interfacing with user interface 111 that may have an "Up" button or lever, for example. The motor 112, shown in FIGS. 22 and 23 the drives cables 114, shown in FIG. 22 to lift the strap-bar to an up or secure position. The motor may be an electric motor that has a power supply 118, such as batteries, or preferably rechargeable batteries. A portion of the strap-bar assembly 122 is configured to couple with the rails to retain the strap-bar assembly in place and to guide it up and down along the rail. A portion of the strap-bar assembly, such as the rail couplers or the strap-bar itself, may have a slot for riding along a protrusion of the rail, or may have a protrusion for extending into a slot that runs along the rail. As shown in FIG. 21, the rail couplers 117 have a slot 115, a dove-tail shaped recess, for guiding the strap-bar assembly 122 up along the protrusion 121, a dove-tail shaped protrusion, of the actuator rail, as shown in FIG. 20. The strap bar 127 is configured to rotate or spin and has strap-bar teeth 128, as shown in FIG. 20 for engagement with the rail teeth 126 that spin the strap-bar to take up slack in the strap 80. As shown in FIG. 19, the strap-bar assembly 122 is in the process of being lifted up, as indicated by the large arrow. The strap-bar assembly is just below the rail teeth 126 and is being guided along the actuator rail 116 by the rail coupling slot 115 in the rail coupling 117. When the strap-bar teeth engage with the rail teeth 126, the strap-bar 127 will spin and thereby wrap the strap 80 around the strap attachment portion 129 of the strap-bar, as shown in FIG. 20. The strap 80 is wrapped around the strap-bar in FIG. 20 as the strap-bar has rotated up to the secure position. The strap-bar latch 136 is now holding the strap-bar in the sup and secure position. A user may release the strap-bar latch 136 by pulling the strap-bar release 124, as shown in FIG. 23. As shown in FIG. 23, the cables 114 may extend along the interior of the movable support frame 20, such as along the front rail 23 and the hand rails 22 on the left and right side of the safety walker 10. The cables may extend out of the frame and couple with the strap-bar assembly 122, such as to the rail coupling 117, 117'. The support frame has a handle 130 configured thereon.

Figure 24:
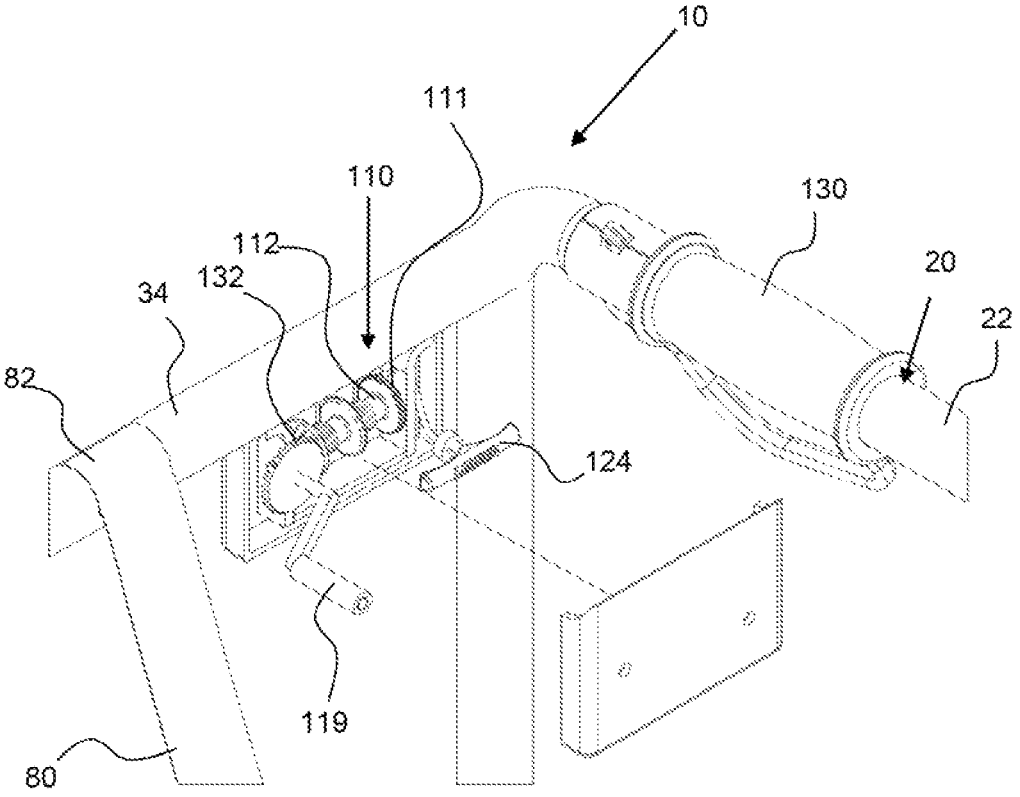
FIG. 24 shows a perspective view of an exemplary safety walker with hand operable actuator system comprising a crank to raise and lower the strap-bar.

As shown in FIG. 24, an exemplary safety walker 10 has a hand operable actuator system 110 comprising a crank 119 to raise and lower the strap-bar. The mechanism of the strap-bar assembly may be the same as that shown and described in FIGS. 15 to 23. The crank may be coupled with one or more gears 132 and these gears may take up a cable 114 to pull the strap-bar up.

Figure 25:
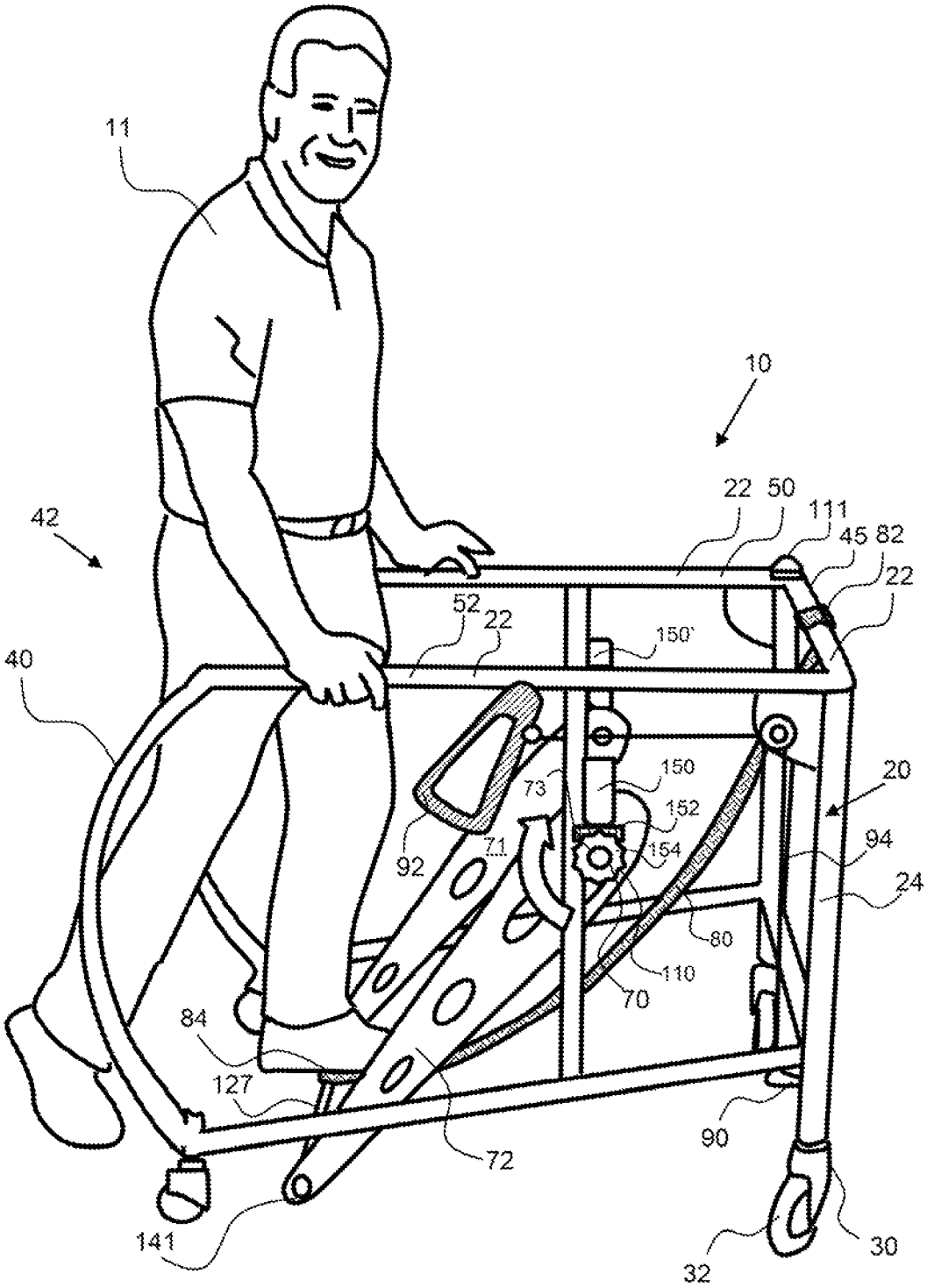
FIG. 25 shows a side view of an exemplary safety walker with motorized actuator system coupled to a pivoting strap mechanism with the strap in a down position.
Figure 26:
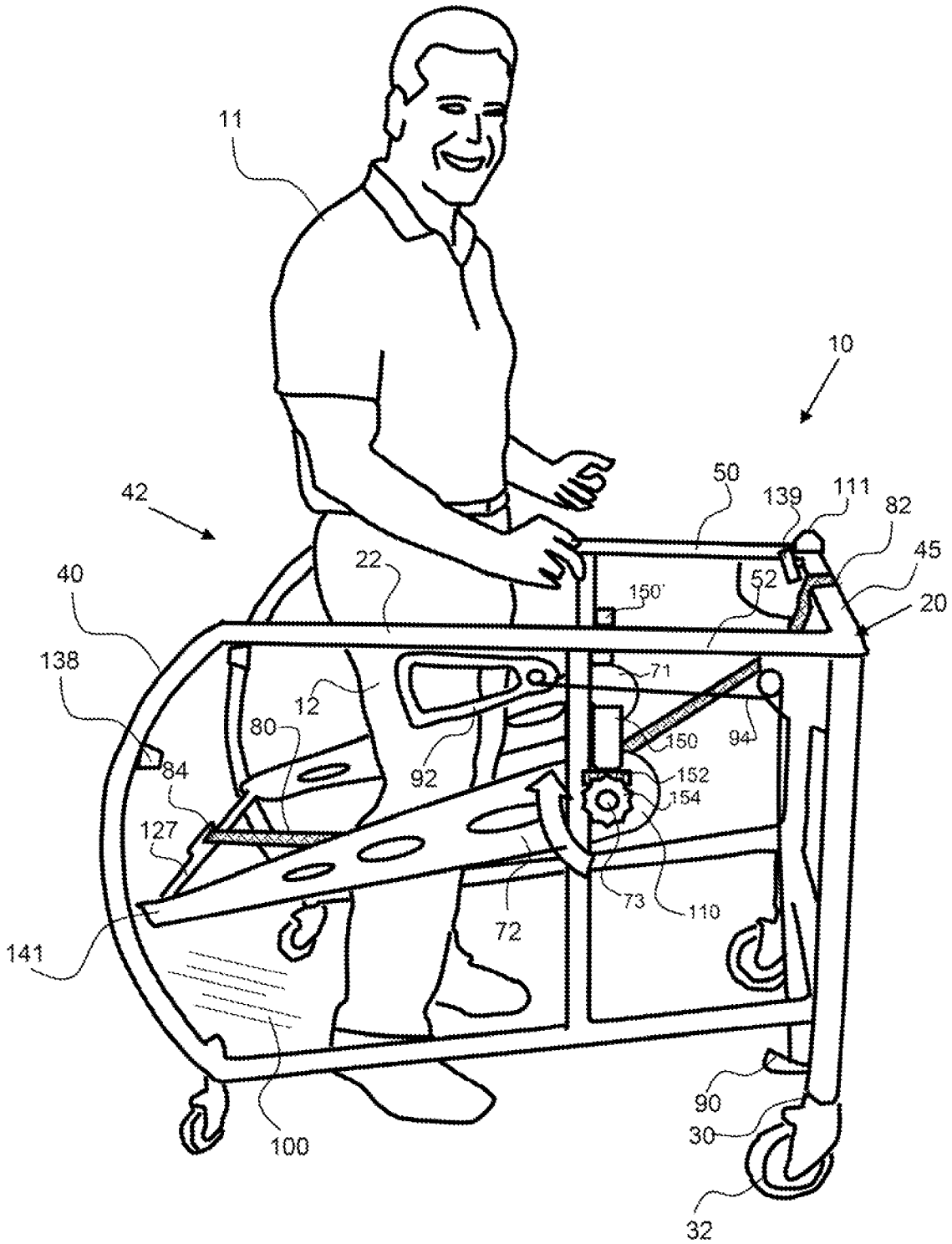
FIG. 26 shows a side view of the exemplary safety walker shown in FIG. 25, with the strap in a partially up position.

As shown in FIGS. 25 and 26, an exemplary safety walker 10 is configured with a motorized actuator system 110 coupled to a pivoting strap mechanism 70. The actuator system 118 comprises a motor 150 attached to the movable frame 20 and having a worm gear 152 that drives a drive gear 154 attached to the strap actuator 72. The left and right strap actuators 71, 72, or first and second strap actuators, rotate about a pivot 73 and have an extended entry end 141 that lifts the strap-bar 127 coupled therebetween up to a secure position, as described herein. A user interface 111 may enable a person to step into the safety walker and press the button or actuate a lever to activate the motor to spin the worm gear 152, which in turn spins the drive gear 154 to rotate the strap actuators 71, 72, the strap-bar 127 and raise the actuating end 84 of the strap 80. As shown in FIG. 25, the strap 80 is in an entry position and is proximal the floor. As shown in FIG. 26, the strap 80 is elevated up as the motor rotates or pivots the strap actuators 72, 71 up. It is to be understood that a single motorized assembly may be configured on the safety walker to drive the strap up and down, as the strap actuators are coupled by the strap-bar 127 that would enable a motorized assembly on one side to drive the pivoting strap mechanism. In an exemplary embodiment, as shown, the safety walker comprises two motorized drive assemblies, one on the left side to drive the left strap actuator and one on the right side to drive the right strap actuator. The user interface may have a physical wire that extends to the motor or may send a wireless signal. The user may simply press a separate button on the user interface to lower the strap actuator by driving the motor in an opposing direction to the direction of rotation to raise the strap, or a strap actuator latch 138 may have a release 139 allow the strap actuators to pivot back down.

Figure 27:
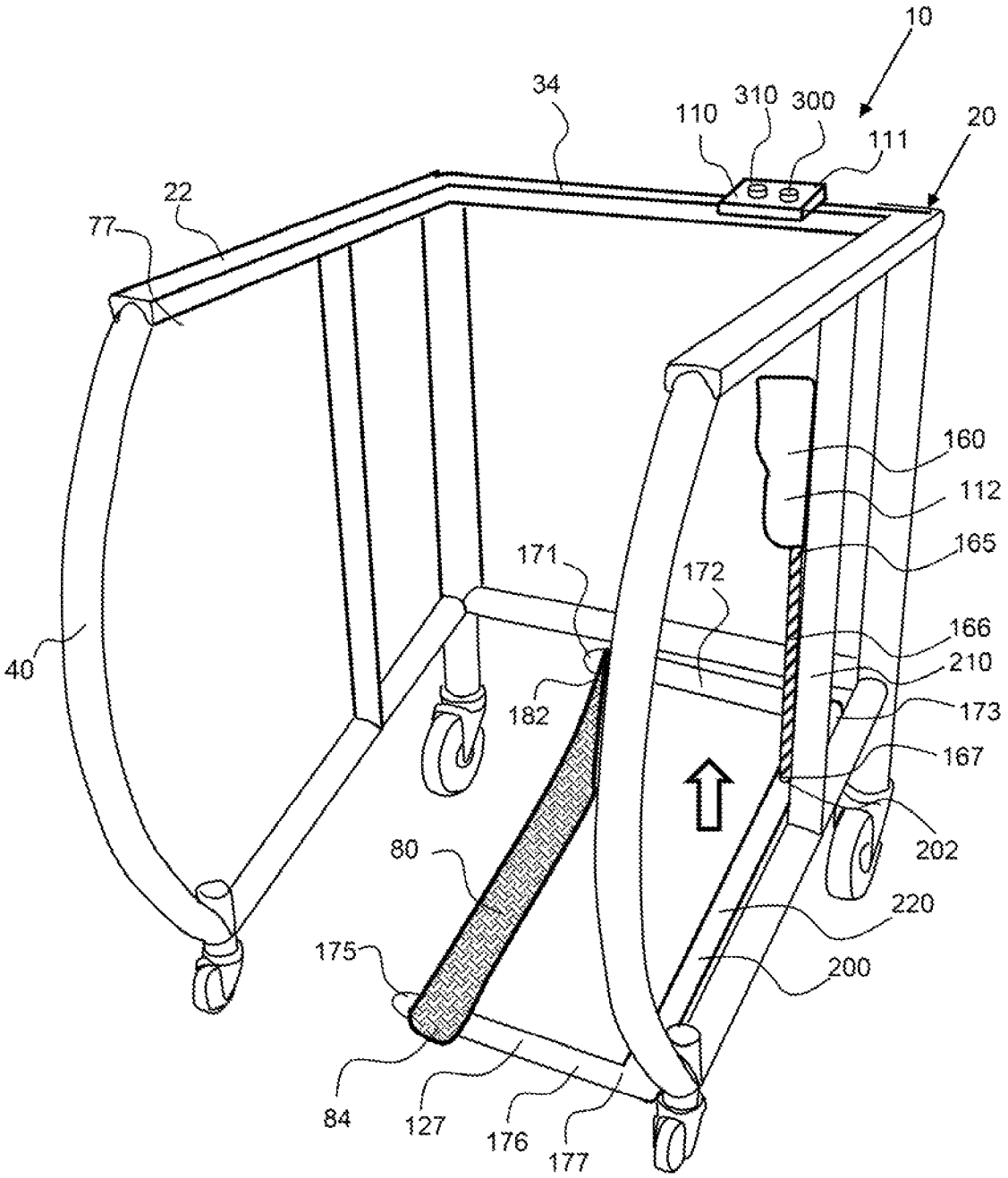
FIG. 27 shows a back-end perspective view of an exemplary safety walker with a safety strap assembly that actuates the safety strap up and down by a motor attached thereto, in a down position.
Figure 28:
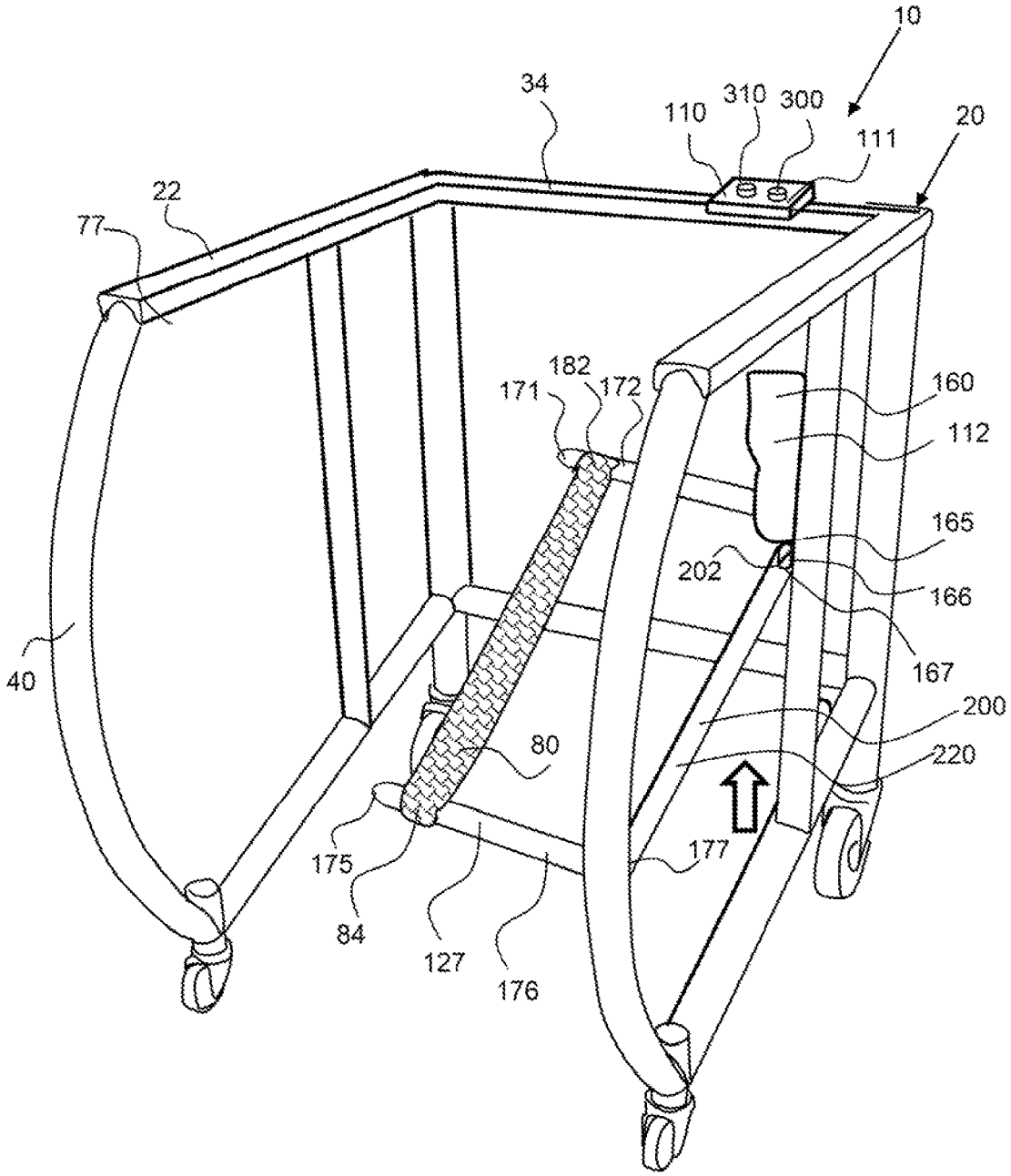
FIG. 28 shows a back-end perspective view of an exemplary safety walker with a safety strap assembly that actuates the safety strap up and down by a motor attached thereto, in an up position.

Referring to FIGS. 27 and 28, an exemplary safety walker 10 has a safety strap assembly 220 that actuates the safety strap up and down by a motor 112 attached to an assembly extension 200 that extends between the back end coupler 176 and the front end coupler 172. The assembly extension has a threaded coupler 202, or female threads that mate with the threaded shaft to move the assembly extension up and down when the drive shaft 166, or threaded shaft, rotates. When the drive shafts spins one direction, the strap assembly will move up and when the drive shaft spins in the opposite direction, the strap assembly moves down. The safety strap assembly retains the safety strap 80 between the front end coupler 172 and the back end coupler 176, or strap bar 127. The safety strap 80 extends from front attached end 182 and the back actuating end 84 The motor is a screw type motor 160, also referred to as a linear screw actuator, that has a threaded drive shaft 166. The motor turns the drive shaft which couples with the assembly extension to move it up and down. The threaded shaft has a motor end 165 that couples with the screw motor 160, by the threaded coupler, and an extension that couples with the assembly extension. The threaded coupler may be a threaded portion of the assembly extension 200, or a separate component that is attached to the assembly extension, such as an insert within the assembly extension. The front end coupler 172 has a front coupler extended end 171 that is configured part way across the interior of the movable support frame from one side towards the opposing side. Likewise, the back end coupler 176, extends from the assembly extension 200 across a portion of the back end of the support frame, or across the entry end of the safety walker to the back coupler extended end 175. The back end coupler or strap bar, as shown in FIGS. 27 and 28 extends across the back end opening a portion of the back end opening. The back end coupler 176, or strap bar 127, may be positioned proximal to or touch the ground in a down position to enable easy entry into the safety walker. The back end coupler may be a have a flat configuration to allow easy entry into the safety walker 10. A person may step into the support frame through the entry end and straddle the strap. The person may then utilize the actuator system 110 and the user interface 111 to control the height of the strap assembly. The user interface has an up button 310, to move the safety strap assembly 220 up to an up position, as shown in FIG. 28, and a down button 300, to move the strap assembly down. When the person wants to exit the safety walker, the user may push the down button, of the user interface to move the strap assembly down to step out of the safety walker.

Figure 29:
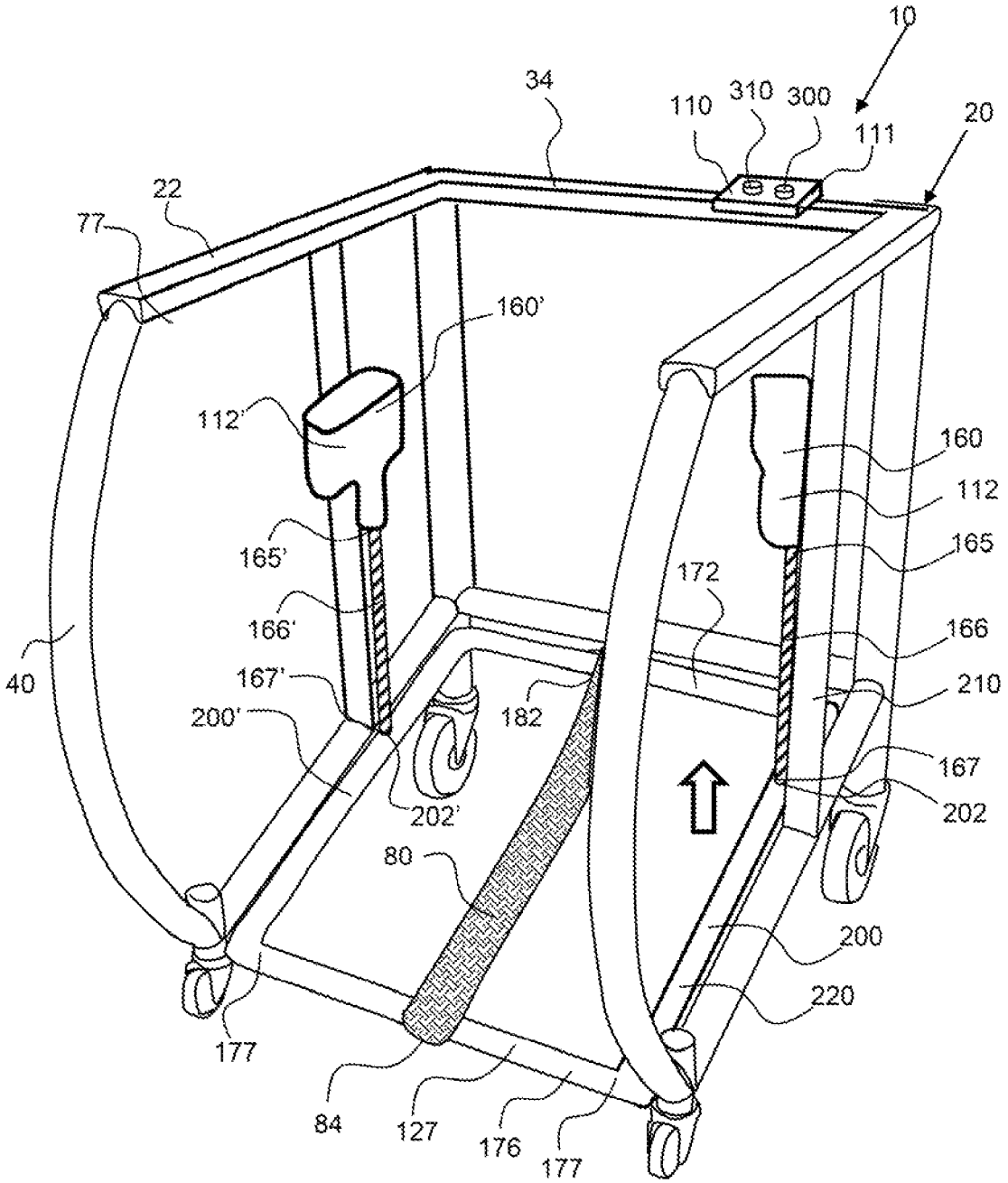
FIG. 29 shows a back-end perspective view of an exemplary safety walker with a safety strap assembly having a left and right side assembly extension and a front coupler and back coupler extending therebetween.

As shown in FIG. 29, the strap assembly 200 is a contiguous assembly, wherein the front coupler 172 and back coupler 176 or strap bar 127 are connected to the left-side assembly extension 200' and right-side assembly extension 200. In this embodiment, a first motor 112 is configured on the right side of the support frame 20 and a second motor 112' is configured on the left side of the support frame and each are coupled with the strap assembly 220 by the threaded coupler 202 to move it up and down. The motors shown are screw motors 160, 160', having a threaded shaft 166, 166' that couples with the strap assembly. It is to be understood that any of the actuators systems as described herein may be utilized to move the strap assembly 220 up and down, including a motor with a gear drive that couples with the strap assembly, or a motor that couples with a cable, belt or chain that is coupled with the strap assembly.

Figure 30:
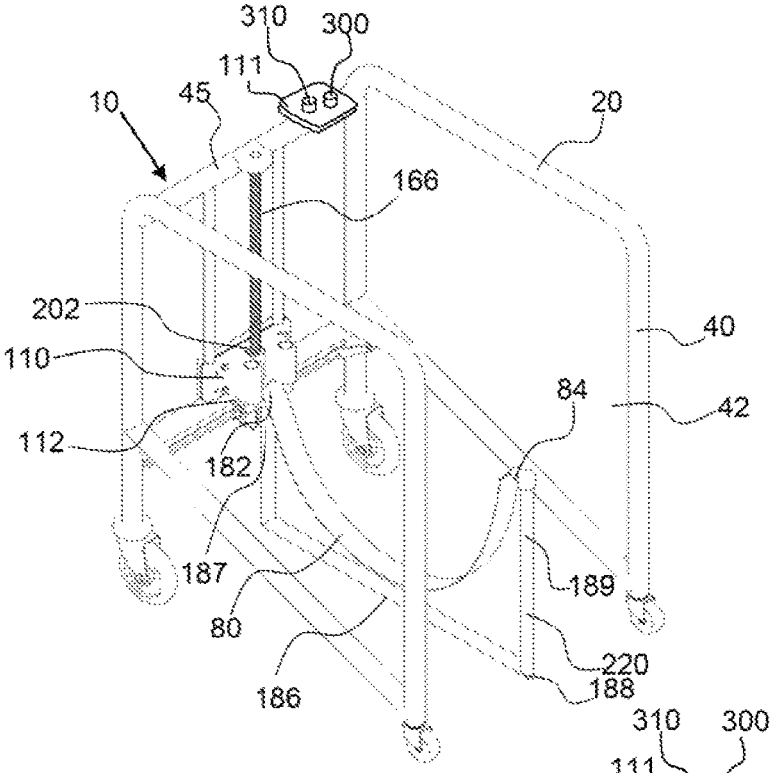
FIGS. 30 and 31 show perspective views of an exemplary safety walker having a support extension that extends from an actuator system at the front of the moveable support frame toward the back-end opening that moves up by an actuator system to lift the strap up to a secure position.
Figure 31:
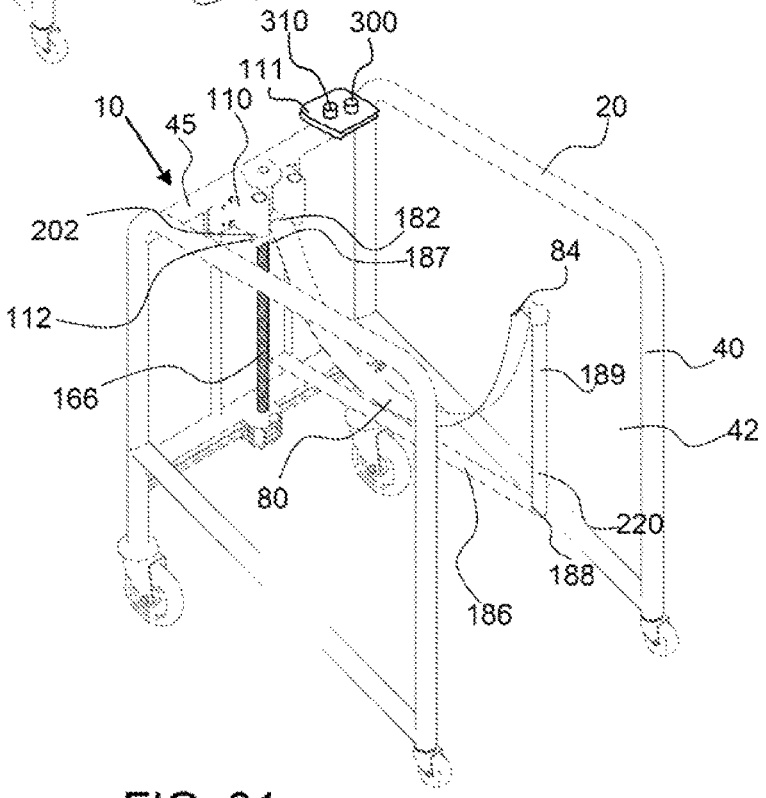

As shown in FIGS. 30 and 31 an exemplary safety walker 10 has a support extension 186 that extends from an actuator system 110 at the front of the moveable support frame 20 toward the back-end opening 42. The support extension moves up by the actuator system to lift the strap 80 up to a secure position. The support extension is coupled with an actuator system having a motor 112 and a drive shaft 166 that moves the threaded coupler 202 and the support extension 186 as well as the fixed end of the strap 82 up. The back actuating end 84 of the strap 80 is attached to the extended end 188 of the support extension and moves up with the support extension. The support extension has a vertical support portion 189 that extends up from the support extension proximal the back-end opening 42 or to the extended end of the support extension from a horizontal portion. As shown in FIG. 30 the horizontal portion of the support extension is configured proximal to the floor. A user may simply walk into the safety walker through the back end opening 42 and straddle the support extension and the strap 80 coupled thereto. The user may then utilize the user interface 111 of the actuator system 110 to control the height of the strap. The user interface has an up button 310, to move the safety strap assembly 220 up to an up position as shown in FIG. 31 and a down button 300 to move the strap down.

Figure 32:
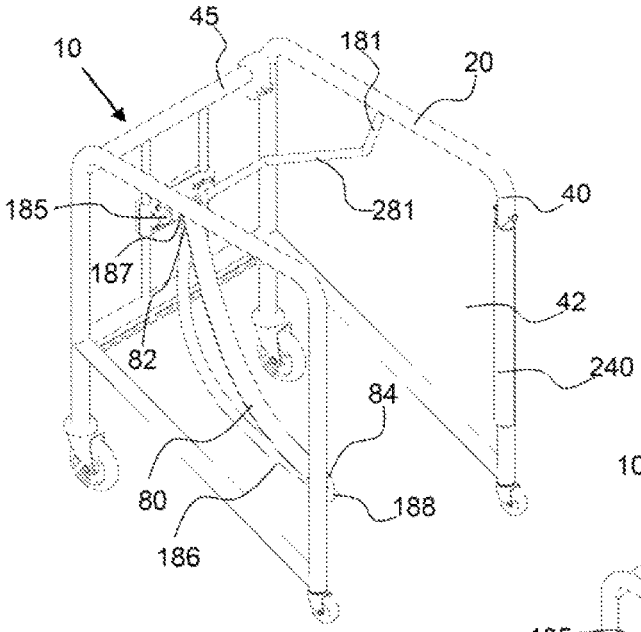
FIGS. 32, 33 and 34 show perspective views of an exemplary safety walker having a support extension that extends from a support pivot at the front of the moveable support frame toward the back-end opening to lift the strap attached thereto up to a secure position.
Figure 33:
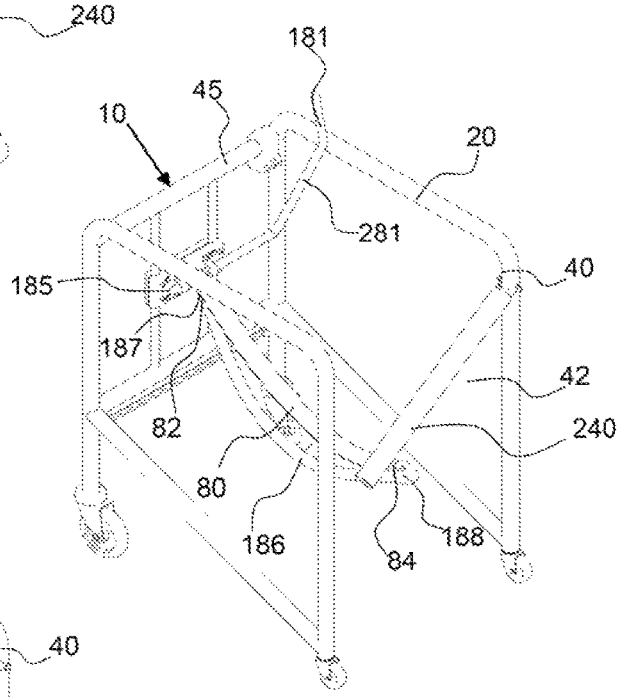
Figure 34:
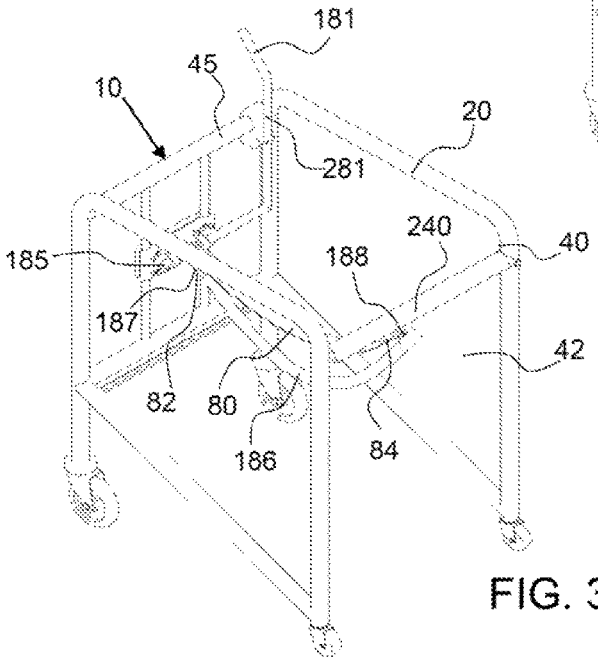

As shown in FIGS. 32 to 34, an exemplary safety walker 10 has a support extension 186 that extends from a support pivot 185 at the front 45 of the moveable support frame 20 toward the backend opening 42 to lift the strap 80 attached thereto up to a secure position. The support extension has a front attached end 187 and an extended end 188. The support extension is curved along the length and has a concave shape. The strap 80 is attached to the support extension proximal to the extended end and extends above the support extension from the actuating end 84 to the fixed end. The concave shape of the support extension produces a space between the safety strap and the support extension along a middle portion of the length of the support extension. A support pivot lever 281 extends from the support pivot 185 and has a support pivot handle 181 to enable a user to rotate the support extension and strap attached thereto up to secure position, as shown in FIG. 34. The support pivot lever is coupled to the support extension 186. As shown in FIG. 32 the support extension is configured proximal to the floor and in FIG. 33 the support pivot lever is actuated to lift the support extension partially up. As shown in FIG. 34 the support pivot lever 281 is retained in a latch to secure the lever, the support extension and the strap 80 in an up and secure position. A gate 240 is attached to a support member along the back 40 of the moveable support frame 20 and is actuated to extend across the back-end opening or from one side toward the second side in a substantially horizontal orientation to prevent users from stumbling back and out of the safety walker. A cable may extend from the support pivot 185 mechanism to automatically actuate the gate from an entry orientation, as shown in FIG. 32 to a secure orientation, as shown in FIG. 34.

Figure 35:
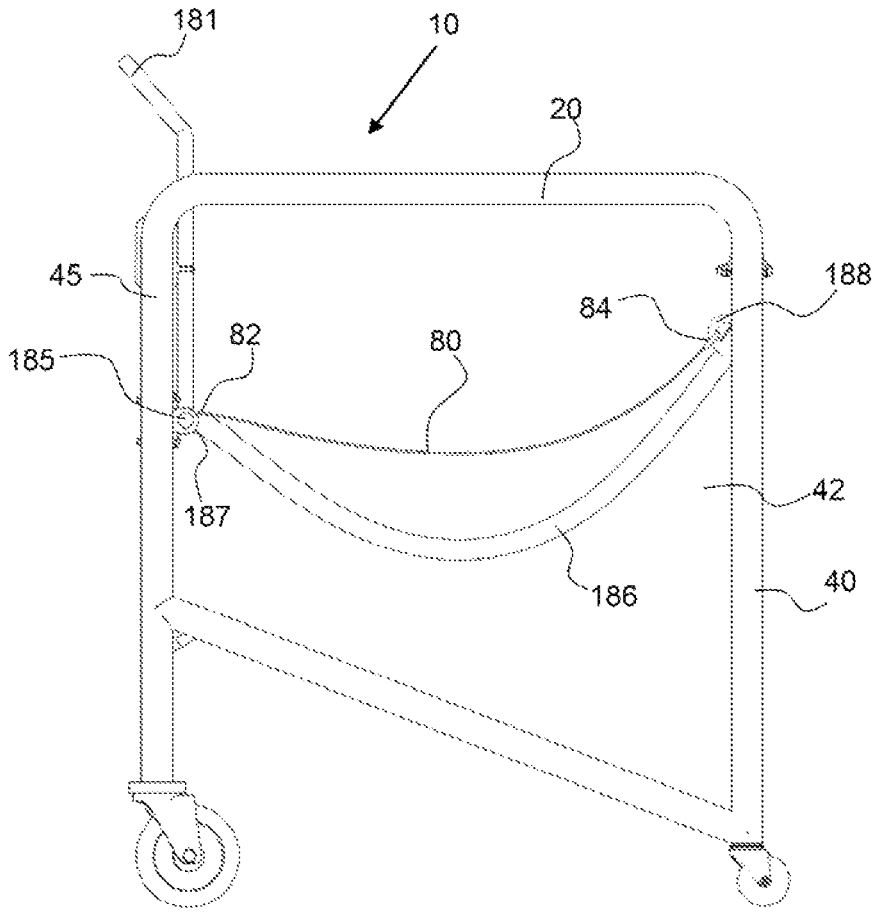
FIG. 35 shows a side view of an exemplary safety walker having a support extension that extends from a support pivot at the front of the moveable support frame toward the back-end opening to lift the strap attached thereto up to a secure position.

As shown in FIG. 35, an exemplary safety walker 10 has a support extension 186 that extends from a support pivot 185 at the front 40 of the moveable support frame 20 toward the back-end opening 42 or back end 40 of the moveable support frame. The support extension pivots about the support pivot 185 and the extended end 188 is lifted up to a secure position, as shown. The strap 80 is attached to the support extension and extends above the support extension from the fixed end 82 to the actuating end 84. The fixed end 82 is shown attached proximal to the support pivot 185 but could be attached to a top support member of the support frame, or any portion of the support frame proximal the front and substantially centered between the left and right sides.

Figure 36:
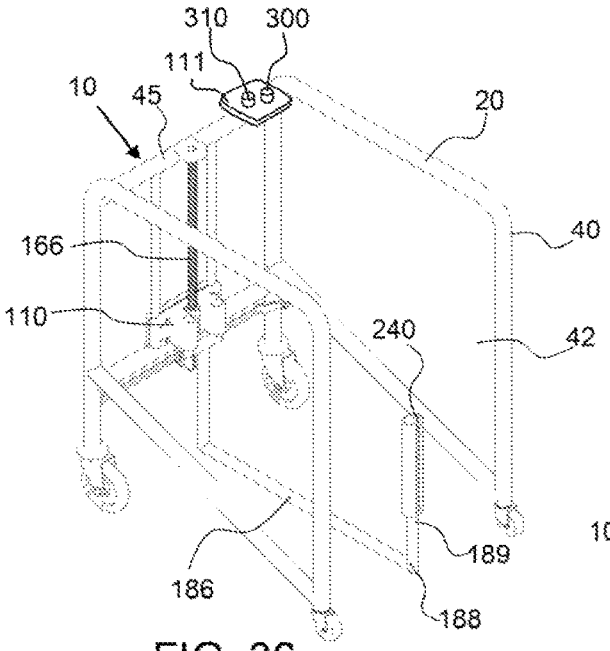
FIGS. 36, 37 and 38 show perspective views of an exemplary safety walker having a support extension that extends from an actuator system at the front of the moveable support frame toward the back-end opening that moves up to a secure position and has a gate that extends out from the extended end of the support extension.
Figure 37:
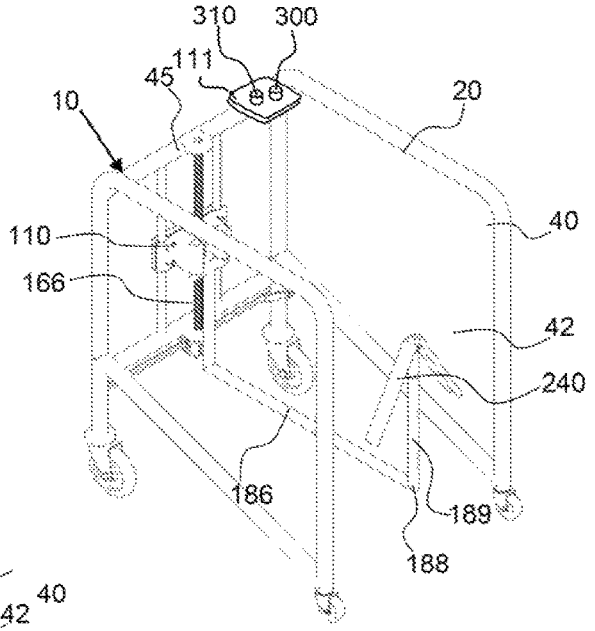
Figure 38:
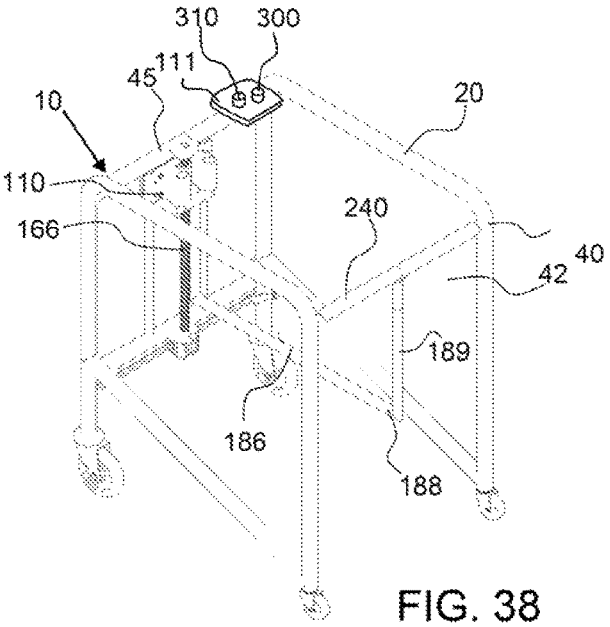

As shown in FIGS. 36 and 38 an exemplary safety walker 10 has a support extension 186 that extends from an actuator system 110 at the front of the moveable support frame 20 toward the back-end opening 42. The support extension may break a user's fall as it extends through their legs as the navigate the safety walker with the support extension in a secure orientation. The support extension moves up by the actuator system to a secure position, as shown in FIG. 38. The support extension is coupled with an actuator system having a motor 112 and a drive shaft 166 that moves the threaded coupler 202 and the support extension 186. The support extension has a vertical support portion 189 that extends up from the support extension proximal the back-end opening 42 or to the extended end of the support extension from a horizontal portion. This vertical support extension may prevent a user from stumbling back out of the safety walker during use. As shown in FIG. 36 the horizontal portion of the support extension is configured proximal to the floor. A user may simply walk into the safety walker through the back end opening 42 and straddle the support extension. The user may then utilize the user interface 111 of the actuator system 110 to control the height of the strap. The user interface has an up button 310, to move the safety strap assembly 220 up to an up position as shown in FIG. 31 and a down button 300 to move the strap down. A gate 240 is attached to the extended end 188 of the support extension 186 and pivots from an entry orientation, as shown in FIG. 36 with the gates configured along the support extension, to a secure position as shown in FIG. 38, wherein the two portions of the gate are extended out toward the left and the right sides of the support frame. The first and second portions of the gate extend substantially horizontally in FIG. 38 and substantially vertically in FIG. 36. The gates may not extend all the way to the left and right sides of the support frame. Also, the gates may pivot to a secure position automatically. The actuator system may actuate a cable that extends through the support extension to the gate portions. As the support extension moves up, the cable may with withdrawn, for example, to pivot the gates up to a secure position.

Figure 39:
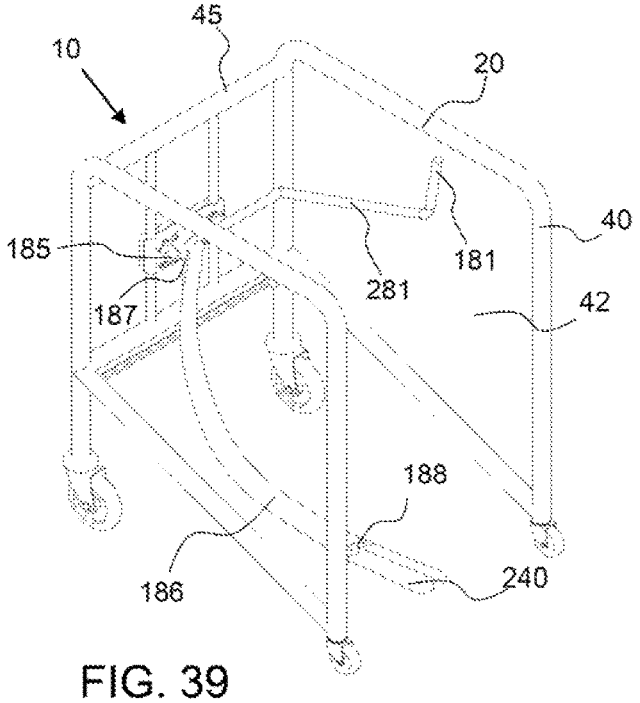
FIGS. 39, 40 and 41 show perspective views of an exemplary safety walker having a support extension that extends from a support pivot at the front of the moveable support frame toward the back-end opening that lifts up to a secure position and has a gate that extends out from the extended end of the support extension.
Figure 40:
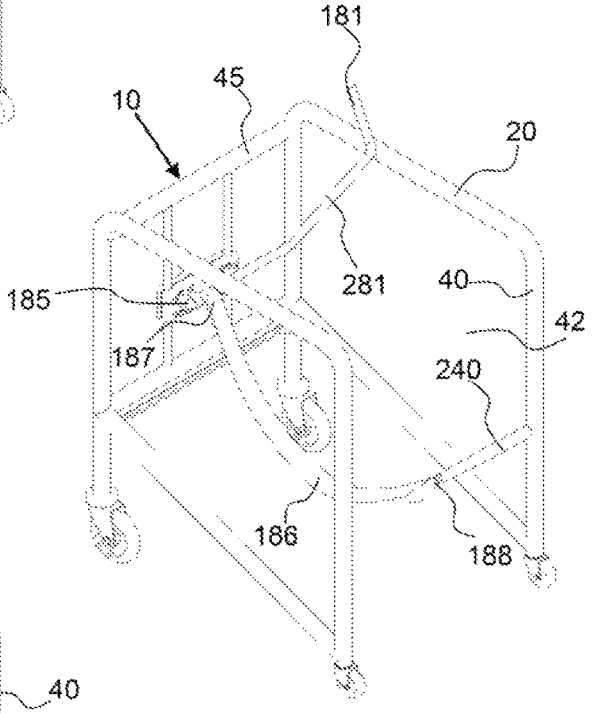
Figure 41:
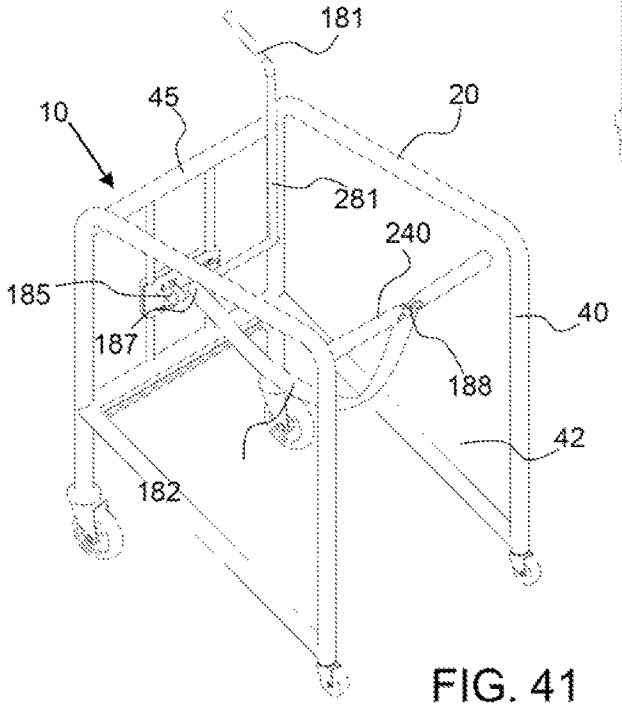

As shown in FIGS. 39 to 41, an exemplary safety walker 10 has a support extension 186 that extends from a support pivot 185 at the front 45 of the moveable support frame 20 toward the back-end opening 42. The support extension pivots from an entry position, as shown in FIG. 39 to a secure position as shown in FIG. 41. The support extension may break a user's fall as it extends through their legs as the navigate the safety walker with the support extension in a secure orientation. The support extension has a front attached end 187 and an extended end 188. A support pivot lever 281 extends from the support pivot 185 and has a support pivot handle 181 to enable a user to rotate the support up to secure position, as shown in FIG. 41. The support pivot lever 281 is coupled to the support extension 186. As shown in FIG. 39 the support extension is configured proximal to the floor and in FIG. 40 the support pivot lever is actuated to lift the support extension partially up. As shown in FIG. 41 the support pivot lever 281 is retained in an up and secure position. A gate 240 is attached to the support extension 186 and is actuated to extend across at least a portion of the back-end opening 42 in a substantially horizontal orientation to prevent users from stumbling back and out of the safety walker. A cable may extend from the support pivot 185 mechanism to automatically actuate the gate from an entry orientation, as shown in FIG. 39, wherein the gate portions extend along the support extension, to a secure orientation, as shown in FIG. 41, wherein the gate portions extend substantially perpendicularly to the support extension.

Figure 42:
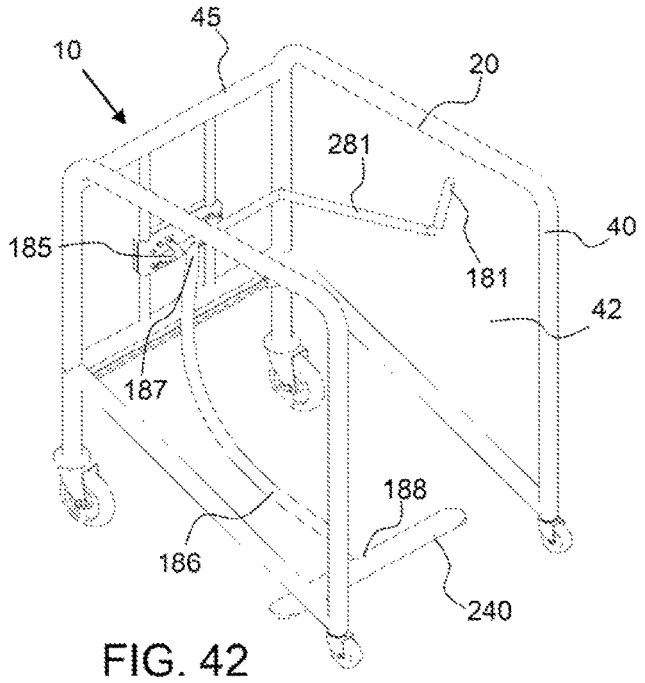
FIGS. 42, 43 and 44 show perspective views of an exemplary safety walker having a support extension that extends from a support pivot at the front of the moveable support frame toward the back-end opening that lifts up to a secure position and has a gate that extends out from the extended end of the support extension.
Figure 43:
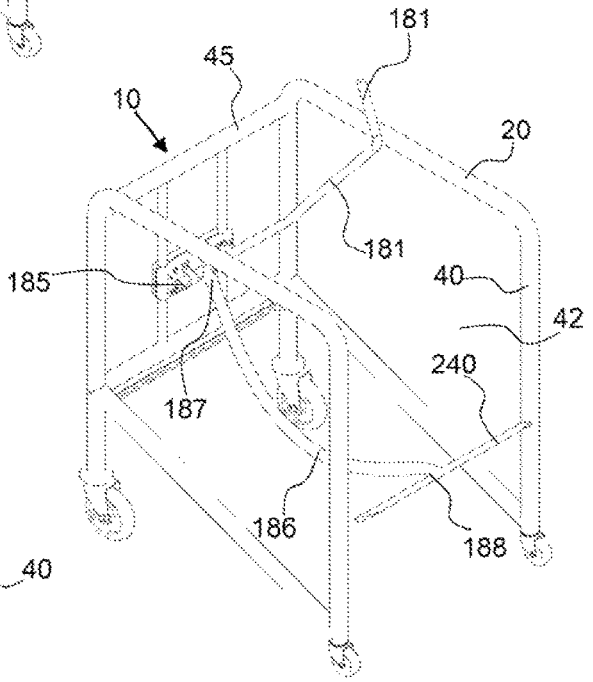
Figure 44:
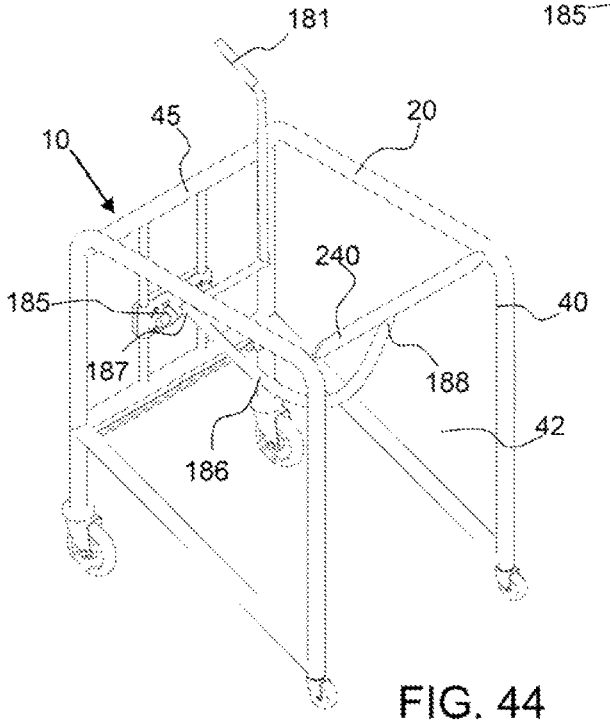

As shown in FIGS. 42 to 44, an exemplary safety walker 10, similar to that shown in FIGS. 39 to 41 has a fixed gate 240. The gate extends substantially perpendicularly to the support extension 186. As shown in FIG. 42 the gate rests on the floor when the support extension and safety walker are in an entry orientation. A user would simply have to walk over the gate and straddle the support extension and then actuate the support pivot lever 281 to raise the support extension up to a secure position, as shown in FIG. 44. The support extension may lock into the secure position by actuation of the support pivot lever or handle. The gate 240 shown in FIGS. 42 to 44 may not extend all the way across the back-end opening 42, but rather a portion of the distance across the back-end opening or from the left side to the right side.

Figure 45:
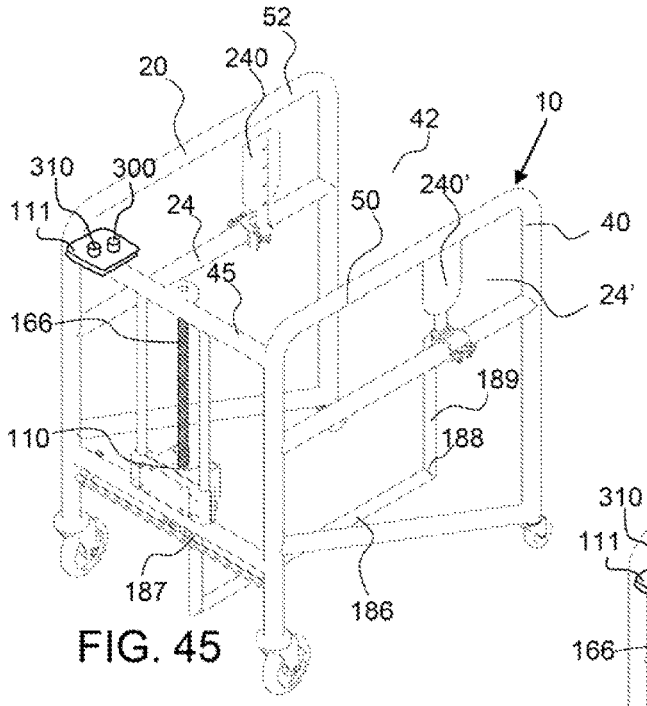
FIGS. 45, 46 and 47 show perspective views of an exemplary safety walker having a support extension that extends from an actuator system at the front of the moveable support frame toward the back-end opening that moves up to a secure position and a gate that is attached to support members of the left and right sides of the moveable support frame and pivot down from a upward orientation to provide a gate and a seat.
Figure 46:
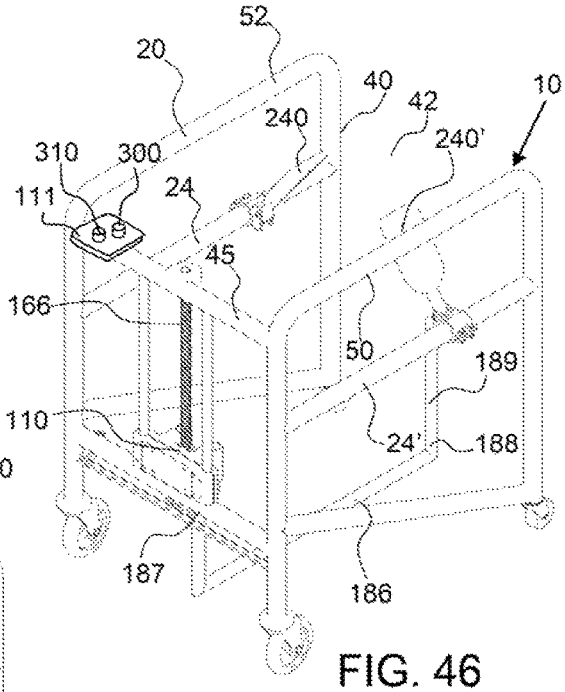
Figure 47:
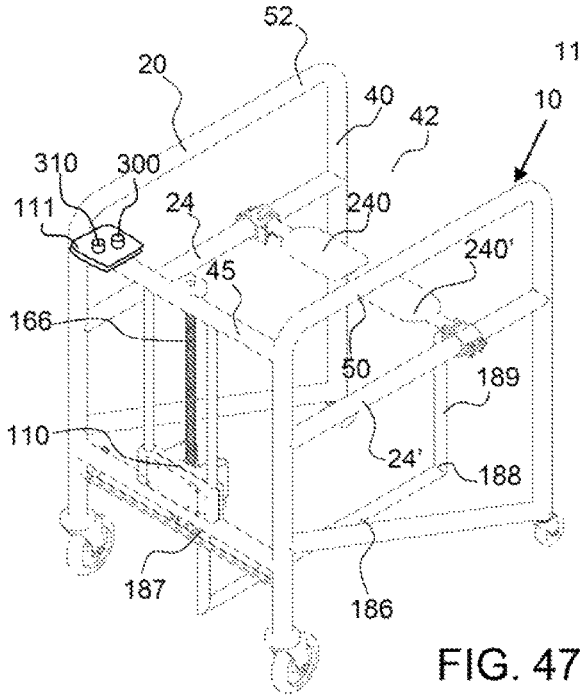

As shown in FIGS. 45 to 47, an exemplary safety walker 10 has a support extension 186 that extends from an actuator system 110 at the front 45 of the moveable support frame 20 toward the back-end opening 42 or back of the moveable support frame 40. The support extension move up to provide a support for a user that might fall while straddling the support extension. A pair of gates 240, 240' are coupled to the right side 52 and left side 50 of the moveable support frame 20 respectively. The gates pivot from an entry orientation wherein they extend along the sides of the moveable support frame in a substantially vertical orientation as shown in FIG. 45, to a secure position where they extend out from the moveable support frame in a substantially horizontal orientation as shown in FIG. 47. The gates may automatically actuate from the entry orientation to the secure orientation wherein a cable or other coupler extends from the actuating system to the gates. A cable may extend through the support members of the moveable frame from the actuating system 110 to each of the gates.

Figure 48:
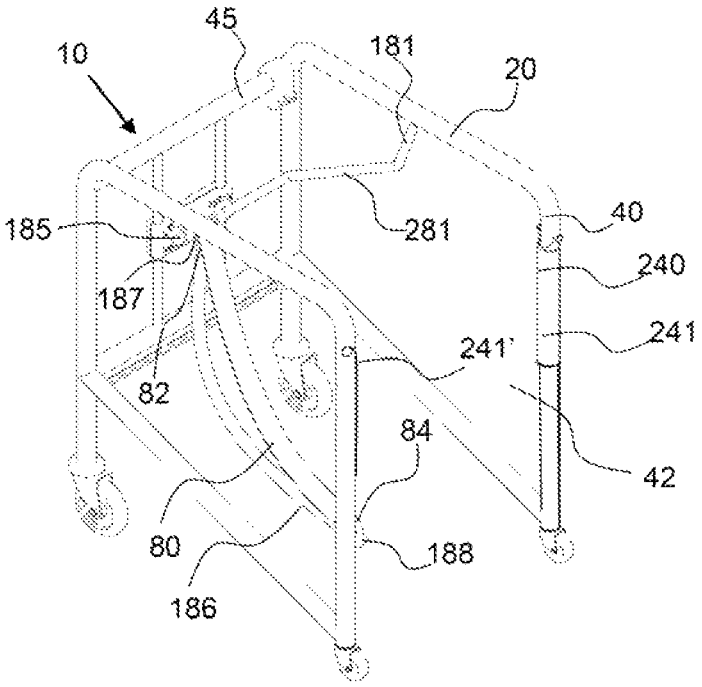
FIGS. 48 and 49 show perspective views of an exemplary safety walker having a support extension that extends from a support pivot at the front of the moveable support frame toward the back-end opening to lift the strap, attached thereto, up to a secure position and a gate comprising two gate extensions that pivot up to a secure position from a connection with the moveable support frame.
Figure 49:
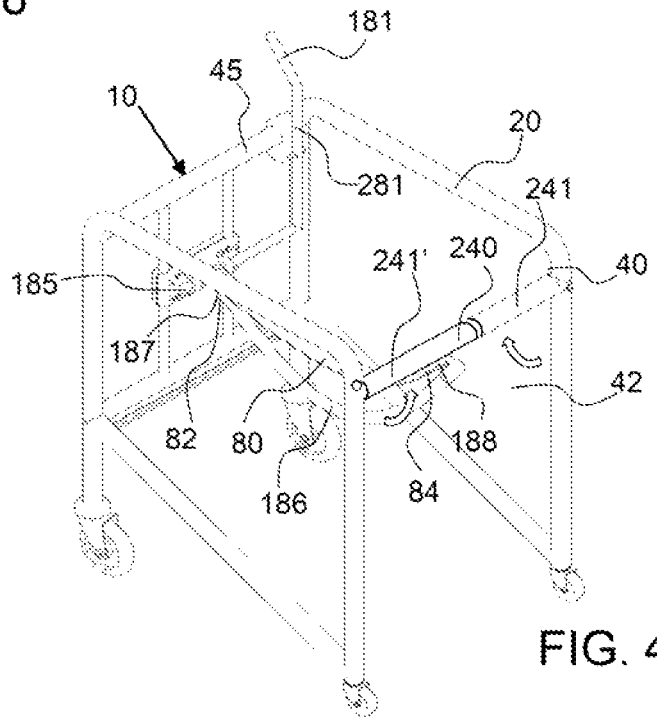

As shown in FIGS. 48 and 49 the gate 240 comprises a first gate extension 241 and a second gate extension 241'. The gate extensions are attached to a support member along the back 40 of the moveable support frame 20 and are actuated to extend across the back-end opening to prevent users from stumbling back and out of the safety walker. The first gate extension 241 extends from the right side of the moveable support frame and has an extended end that is actuated up from an entry position, wherein the extended end is proximal to the support frame, to secure position, wherein the extended end is lifted to point toward the left side of the movabable support frame. The second gate extension 241' extends from the left side of the moveable support frame and has an extended end that is actuated up from an entry position, wherein the extended end is proximal to the support frame, to secure position, wherein the extended end is lifted to point toward the right side of the movabable support frame. The gate extensions may have a geometry to that extends around a portion of the support frame, such as a curved inner surface that cups around a cylindrical support member of the support frame, as shown. This type of concentric geometry of the gate extension with the support frame may enable less obstruction when entering the support frame. A cable may extend from the support pivot 185 mechanism to automatically actuate the gate from an entry orientation, as shown in FIG. 48 to a secure orientation, as shown in FIG. 49.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A safety walker comprising:

a) a movable support frame comprising:
- i) a base having a plurality of wheels;
- ii) a front;
- iii) a left side extending back from the front to an extended end;
- iv) a right side extending back from the front to an extended end;
- v) a width between the left and right sides;
- vi) a back end having an opening between said left and, right sides for entry into the movable support frame;

b) a support extension comprising a single rigid beam comprising:
- i. a front attached end that is substantially centered across the width of the movable support frame;
- wherein the front attached end is within 25% of a center of said width;
- ii. an extended end;
- iii. a rigid length from the front attached end to the extended end;
- wherein the support extension extends from the front attached end towards the back end of the moveable support frame and from said substantially central location between the left and right sides of the moveable support frame;
- wherein the support extension actuates from an entry orientation, wherein the extended end is in a down position, to a secure orientation, wherein the extended end is in an elevated position; and
- wherein in a secure orientation the support extension is located between a users legs, wherein the front attached end is in front of said user and the extended end is behind said user; and c) an actuating gate that is attached to the support extension proximal to the extended end and has an entry orientation and a secure orientation;
- wherein in said entry orientation, the gate extends substantially parallel with the length of the support extension; and
- wherein in said secure orientation, the gate extends horizontally out from the support extension towards the left and right sides of the moveable support frame.

2. The safety walker of claim 1, wherein the support extension comprises a horizontal portion along the length of the support extension.

3. The safety walker of claim 1, wherein the support extension comprises a vertical support portion configured proximal to the extended end of the support extension.

4. The safety walker of claim 1, wherein the support extension is concaved shaped along the length.

5. The safety walker of claim 1, wherein the gate is coupled with an actuating system wherein the gate automatically actuates from the entry orientation to the secure orientation when the actuator system moves the support extension up to a secure position.

6. The safety, walker of claim 1, further comprising an actuator system comprising:

a) a pivot;

wherein the front attached end of the support extension pivots about the pivot to move the extended end of the support extension up to an elevated position.

7. The safety walker of claim 6, wherein said actuator system comprises a support pivot lever attached to the support extension, wherein manual rotation of the support pivot lever rotates the extended end of the support extension.

8. The safety walker of claim 6, wherein said actuator system comprises a motor to rotate the support extension about the pivot.

9. The safety walker of claim 1, further comprising an actuator system comprising a motor to drive the front attached end of the support extension up and down, wherein the front attached end and the extended end of the support extension move up in unison.

10. The safety walker of claim 9, wherein the actuator system further comprises:

a) a drive screw;

b) a threaded coupler coupled to the drive screw;

c) a motor that rotates the drive screw to move the threaded coupler up and down;

wherein the front attached end of the support extension is coupled with the threaded coupler and moves up and down with the threaded coupler.

11. The safety walker of claim 10, wherein the motor is a screw motor having a threaded shaft that couples with the threaded coupler.

12. The safety walker of claim 1, wherein a safety strap is connected to the support extension and extends above the support extension along al least a portion of the length of the support extension.

13. The safety walker of claim 12, wherein the safety strap is connected to the support extension proximal to the extended end of the support extension.

14. The safety walker of claim 12, wherein a front attached end of the safety strap is connected to a support of the moveable support frame.

15. A safety walker comprising:

a) a movable support frame comprising:

i) a base having a plurality of wheels;

ii) a front;

iii) a left side extending back from the front to an extended end;

iv) a right side extending back from the front to an extended end;

v) a width between the left and right sides;

vi) a back end having an opening between said left and right sides for entry into the movable support frame;

b) a support extension comprising a single rigid beam comprising:

i. a front attached end that is substantially centered across the width of the movable support frame;

wherein, the front attached end is within 25% of a center of said width;

ii. an extended end;

iii. a rigid length from the front attached end, to the extended end;

wherein the support extension extends from the front attached end towards the back end of the moveable support frame and from said substantially central location between the left and right sides of the moveable support frame;

wherein the support extension actuates from an entry orientation, wherein the extended end is in a down position, to a secure orientation, wherein the extended end is in an elevated position; and wherein in a secure orientation the support extension is located between a user's legs, wherein the front attached end is in front of said user and the extended, end is behind said user; and c) an actuating gate attached to the moveable support frame that moves from an entry orientation, wherein the actuating gate is configured along the moveable support frame to a secure orientation: wherein the gate extends across the moveable support frame from the left or right side of the movable support frame toward the opposing side; and wherein the actuating gate is coupled with an actuating system wherein the gate automatically, actuates from the entry orientation to the secure orientation when the actuator system moves the support extension up to a secure position.

16. The safety walker of claim 15, wherein the actuating gate comprises a left gate extension that is attached to the left side of the moveable support frame and a right gate extension that is attached to the right side of the moveable support frame;

wherein the left and right gate extensions have an entry orientation wherein the said gate extensions extend along the moveable support frame and a secure orientation, wherein the left and right gate extensions extend from the left and right side of the moveable support frame, respectively, toward the opposing side.

17. The safety walker of claim 16, wherein the left and right gate extensions are coupled with an actuator system and wherein the gate extensions automatically actuate from the entry orientation to the secure orientation when the actuator system moves, the support extension to secure position.

18. The safety walker of claim 15, wherein the gate is configured proximal to the back end opening of the moveable support frame.

19. The safety walker of claim 15, wherein the gate has a flat top surface and padding on said flat top surface to produce a seat for a user when in a secure orientation.

* * * * *